US009048034B2

(12) United States Patent
Petty et al.

(10) Patent No.: US 9,048,034 B2
(45) Date of Patent: Jun. 2, 2015

(54) EXTENDED CONTACT STRIP

(75) Inventors: John Petty, Sheffield (GB); Phillip Petty, Sheffield (GB)

(73) Assignee: Industrial Control Systems Limited, Sheffield (GB)

( * ) Notice: Subject to any disclaimer, the term of this patent is extended or adjusted under 35 U.S.C. 154(b) by 251 days.

(21) Appl. No.: 13/464,505

(22) Filed: May 4, 2012

(65) Prior Publication Data

US 2013/0292238 A1 Nov. 7, 2013

(51) Int. Cl.

| | |
|---|---|
| ***H01H 1/12*** | (2006.01) |
| ***H01H 3/14*** | (2006.01) |
| ***H01H 9/16*** | (2006.01) |

(52) U.S. Cl.

CPC ..... *H01H 1/12* (2013.01); *Y10T 29/49204* (2015.01); *H01H 3/142* (2013.01); *H01H 9/161* (2013.01)

(58) Field of Classification Search

CPC ..... H01H 3/142; H01H 1/02; H01H 11/00; H01H 2003/143; H01H 13/7006

USPC ..... 200/61.43–61.45

See application file for complete search history.

(56) References Cited

U.S. PATENT DOCUMENTS

| | | | | |
|---|---|---|---|---|
| 3,732,384 | A | 5/1973 | Fischel | |
| 3,855,733 | A | 12/1974 | Miller | |
| 4,940,426 | A | 7/1990 | Redmond et al. | |
| 5,148,911 | A | 9/1992 | Miller et al. | |
| 5,260,530 | A | 11/1993 | Duhon et al. | |
| 5,265,324 | A | 11/1993 | Miller et al. | |
| 5,399,851 | A | 3/1995 | Strand | |
| 5,693,921 | A | 12/1997 | Miller et al. | |
| 6,455,793 | B1 | 9/2002 | Kasahara et al. | |
| 6,593,537 | B2 | 7/2003 | Teruyama et al. | |
| 6,740,826 | B1 * | 5/2004 | Friedrich et al. | 200/61.43 |
| 6,898,842 | B2 | 5/2005 | Kasahara et al. | |
| 7,086,113 | B2 * | 8/2006 | Young | 15/104.061 |
| 7,094,064 | B2 | 8/2006 | Sweetland et al. | |
| 7,230,196 | B2 | 6/2007 | Toyama | |
| 7,373,754 | B2 | 5/2008 | Albiero | |
| 7,998,611 | B2 * | 8/2011 | Yoshihara et al. | 429/148 |

FOREIGN PATENT DOCUMENTS

| | | |
|---|---|---|
| EP | 0 129 895 A1 | 1/1985 |
| EP | 0 177 267 A2 | 4/1986 |

(Continued)

*Primary Examiner* — Edwin A. Leon
*Assistant Examiner* — Ahmed Saeed
(74) *Attorney, Agent, or Firm* — Harness, Dickey & Pierce, P.L.C.

(57) ABSTRACT

The extended contact strip has a first elongate strip having first and second longitudinal edges, an upper and a lower surface, a first electrically conductive strip located on the upper surface of the first elongate strip, a second elongate strip having first and second longitudinal edges, and a flexible resilient portion extending between the first and second edges, the flexible resilient portion having an upper and a lower surface, a second electrically conductive strip located on the lower surface of the second strip, the first and second strips being connectable at their respective first and second edges, and the first and second strips forming an isolating gap such that the first and second electrical conductors lie opposite and spaced apart from each other when the second strip remains un-deformed, such that the first and second electrical conductors can make contact with each other upon deformation of the second strip.

25 Claims, 20 Drawing Sheets

(56) References Cited

FOREIGN PATENT DOCUMENTS

| | | | | |
|---|---|---|---|---|
| EP | 1 947 693 | A1 | 7/2008 | |
| EP | 2 154 699 | A2 | 2/2010 | |
| GB | 1 368 174 | | 9/1974 | |
| GB | 2 440 594 | A | 2/2008 | |
| GB | 2477486 | A | 8/2011 | |
| GB | 2477486 | * | 11/2011 | ..... H01H 9/16 |
| JP | 8-036045 | A | 2/1996 | |
| JP | 10-144168 | A | 5/1998 | |
| JP | 2004-146372 | A | 5/2004 | |
| TW | I242614 | B | 11/2005 | |
| WO | 97/41324 | A1 | 11/1997 | |
| WO | 2005/091258 | A1 | 9/2005 | |

* cited by examiner

EXTENDED CONTACT STRIP

FIELD OF THE INVENTION

The present invention relates to electrical contacts, and particularly although not exclusively to extended electrical contact strips.

BACKGROUND OF THE INVENTION

It is known to provide extended electrical contact strips which permit a user to press at any point along the strip. These are used in applications such as police stations where an elongate extended switch is required to be available around a room as an easily reached alarm, or in industrial plants where an extended switch which can be activated along its length is required to trigger a machine safety cut out. Such extended switches are variously known as "press at any point switches", "tape switches", or "ribbon switches" or "linear switches".

The majority of prior art extended or strip contact systems are constructed by having a backing strip of a flexible plastics material, the backing strip having an elongate flat copper strip, and an upper flexible plastics cover, which in cross section has a bridge shaped profile, and to which is attached a second elongate copper or wire strip, facing opposite the first copper or wire strip and spaced apart therefrom. The cover strip is attached to the backing strip along the outer edges, either by glue, or by welding.

Pressing the outer strip causes the cover to deform, and the second metal strip to come into contact with the first metal strip, thereby effecting electrical contact.

Known "press at any point" switches use an open pair of parallel contacts separated by an electrical isolator, usually air, and are encased in a polymer or rubber body. The shape of the switch body and the ability of the polymer or rubber body to deform and return to its original shape is critical to the operation of such known switches.

The body shape, and hence the separation between electrical contacts in these known devices are maintained by one of three methods.

In a first method, two contacts are manufactured from metal springs and encased in a polymer or rubber body.

In a second method, a single metal spring is concealed in a polymer or rubber body.

In a third method, a polymer or rubber body having a shape memory is used, with electrical contacts separated by an air gap.

For the third method, press at any point switches manufactured with a polymer or rubber body rely on the deformation of the switch body to cause a pair of electrical contacts to touch each other, creating an electrical circuit.

The switch contacts in this type of press at any point switch are strips of copper or other suitable electrical conductor, backed with laminated polyester or other suitable sacrificial membrane which enables the contact to adhere to, or be welded to an opposing internal face of the switch body to create a pair of contacts separated by an air gap. The body is usually tubular or semi circular in cross-sectional shape.

When an external pressure or force is applied to the switch body, the external walls deform allowing the contacts to touch, creating an electrical circuit. When the pressure or force is removed, the internal forces created by the material shape memory cause the contacts to separate and the body to return to its original shape.

To control the sensitivity of the strip, ridges are sometimes included in the base contact either longitudinally or across the width of the switch. These ridges are used to reduce the effects of poor mechanical and memory properties of the material by reducing the space and distance between the supports of the contact.

In known switch strips, the materials of choice for creating the switch body are PVC and Nitrite rubber. One concern when using flexible PVC to construct a switch body is the weak positional memory of the body shape. PVC material memory can be improved by the addition of elastomers such as Nitrite. The final blend of PVC and Nitrite rubber is therefore a matter of compromise between the characteristics of flexibility (memory), elasticity, and transparency, all of which are desirable in the contact strip.

Depending on the application of the switch strip, the two main components of the switch, the base plate and the cover may be manufactured from differing blends of PVC Nitrite, with the specific blend being determined usually on the grounds of cost considerations.

One particular form of prior art contact strip product comprises a backing plate or base plate of a flexible plastics sheet material; a cover strip of a flexible plastics material, the cover strip having a bridge or arch shape in cross-sectional view; a first electrically conductive strip bonded to the base plate, and extending along a length of the base plate, and a second electrically conducting strip bonded to an inner surface of the cover strip such that it faces opposite the first conductive strip, there being a gap there between.

The edges of the cover strip are bonded to adjacent surfaces of the base plate.

In use, the base plate of the strip is attached to a surface, for example a wall, and persons may press the strip, making contact between the two electrical contacts. When pressed, the cover member deforms to allow the second contact strip to come into contact with the first contact strip, making electrical connection. The two contacts can be connected into a circuit, such as a switch circuit.

U.S. Pat. No. 3,732,384 discloses a linear switch having a pair of superposed metal strip conductors positioned within a centrally located cavity within a resilient non-conductive casing.

U.S. Pat. No. 4,940,426 discloses a high density electrical connector assembly which uses a woven mesh of conducting filaments.

U.S. Pat. No. 5,260,530 discloses an illuminated press-at-any-point switching device which can be actuated by the application of or the removal of pressure at different points along its outer surface.

U.S. Pat. No. 5,693,921 discloses a linear contact switch having first and second resilient strips and first and second electrically conductive strips.

U.S. Pat. No. 6,455,793 B1 discloses a continuous length switch having first and second electrode plates separated by a plurality of cavities.

U.S. Pat. No. 6,593,537 B2 discloses a membrane switch having a hemispherical metal click spring.

U.S. Pat. No. 6,898,842 B2 discloses a method for manufacturing a continuous length switch having first and second electrodes with a plurality of cavities there between.

U.S. Pat. No. 7,094,064 B2 discloses an electrical switch comprising woven conductors.

U.S. Pat. No. 7,230,196 B2 discloses an illuminated switch device.

U.S. Pat. No. 7,373,754 B2 discloses a safety edge for a motor driven rolling gate having a pair of extended electrical conductors spaced apart within a flexible housing.

EP 2 154 699 A2 discloses an illuminated switch device of the press button type.

SUMMARY OF THE INVENTION

Major technical issues with the known class of press at any point contact strips include the following:

Over sensitivity of the strip to false trigger;

Poor control of the air gap between the contacts;

Limited direction of activation force;

Poor adhesion of the electrical contacts to the switch body;

Achieving good transparency of the switch body;

Susceptibility to damage of the strip due to knife attack or other sharp implement;

Continuous metal strips expand/contract under temperature variations which can cause the strip to buckle or bend, reducing or increasing the spacing between contacts and varying the sensitivity of the strip when used as a switch;

Continuous metal contacts will not bond readily to a flexible plastics such as PVC, or rubbers, so in general prior art devices have a copper contact strip glued to (generally) polyester strip, which is either glued or welded to a PVC strip which means an extra manufacturing step is needed, and the overall flexibility is reduced due to having three layers;

There is failure of the bond between the conductive electrical contacts and the laminated polyester, due to different expansion rates between the different materials;

The manufacture process involves multiple stages of bonding of metal contacts to PVC strips;

The bonding between metal contact strip and PVC carrier strip can easily become loose due to work hardening or general usage.

A single conductor has a single point of failure by breaking the conductor.

Problems with the prior art strips include de-lamination, meaning a breakdown of the bond between the plastics cover or backing plate and the wires or metal contact strips, which can be caused by temperature, having poor contact during manufacture, or to ageing of the plastics material of the cover strip or backing strip. Known strips can become de-laminated due to work hardening of the plastics cover strip and/or backing strip as the strip is repeatedly used.

Where the strips have lighting incorporated in them, for example light emitting diodes, or if there is sunlight or placement near a radiator, the heat and/or light produced can cause expansion of the strip and degradation of the plastics materials used for the cover strip and backing strip, leading to de-lamination, and reduced flexibility of the cover strip and backing strip. In particular, the cover strip can begin to soften and lose its shape memory.

Similarly, the known strips can become de-graded during storage, due to heat.

Known extended electrical contact strips are over sensitive, which can lead to false triggering.

Specific embodiments described herein address the above problems.

According to a first aspect there is provided an extended electrically conductive contact strip comprising:

a bridge portion;

an electrically conductive mesh; and at least one deformable lateral portion located at a side of said bridge portion;

wherein said conductive mesh is partially embedded within said bridge portion; and said at least one deformable lateral portion, said bridge portion and said conductive mesh are formed together in a single extrusion.

According to a second aspect there is provided a method of forming an extended electrical contact strip comprising:

a bridge portion;

an electrically conductive mesh; and at least one deformable lateral portion located at a side of said bridge portion;

said method comprising:

extruding said bridge portion, said conductive mesh, and said at least one deformable lateral portion in a single extrusion process.

According to a third aspect there is provided an extended electrical contact strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming an electrically isolating gap there between, such that said first and second electrical conductors lie opposite and spaced apart from each other and such that said first and second electrical conductors can make contact with each other when said first and second elongate strips are urged towards each other;

wherein at least one of said first and second electrical conductors comprises a web of electrically conductive mesh; and said at least one of said first and second electrical conductors is extruded with a material of a corresponding respective said first or second elongate strip.

According to a fourth aspect there is provided a method of manufacturing an extended contact strip, said strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming an electrically isolating gap there between, such that said first and second electrical conductors lie opposite and spaced apart from each other when said second strip remains uncompressed, and such that said first and second electrical conductors can make contact with each other upon compression of said second strip;

said method comprising:

forming said first elongate strip and said first electrical conductor as a first extrusion said first extrusion having a first side and a second side;

forming said second elongate strip and said second electrical conductor as a second extrusion, said second extrusion having a first side and a second side; and joining said first and second extrusions together along their corresponding respective first sides and second sides.

According to a fifth aspect there is provided an extended electrical contact strip comprising:

an elongate strip having first and second longitudinal sides, an upper surface and a lower surface;

an electrical conductor located on said upper surface of said first elongate strip;

a second elongate strip having first and second longitude sides, and a central section extending between the first and second sides, said central section having an upper surface and a lower surface;

a second electrical conductor located on said lower surface of said second strip;

said first and second strips forming an electrically isolating gap there between, such that said first and second electrical conductors lie opposite and spaced apart from each other when said first and second strips remains spaced apart, and such that said first and second electrical conductors can make contact with each other when said first and second strips are urged towards each other;

wherein as least one of said first or second electrical conductors are extruded into said corresponding respective first or second elongate strips; and said first and second elongate strips are co-extruded with each other.

Embodiments described herein may have an advantage that the cover strip is connected to the backing strip more reliably and robustly than in prior art devices, which means that the strips disclosed herein may be less prone to de-lamination or separation of the cover from the backing strip.

Further, the strips disclosed herein may have better more reliable electrical contact when pressed, due to the greater flexibility of the metal mesh compared to the known individual wires or the known flat copper strips.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

Figure 1:
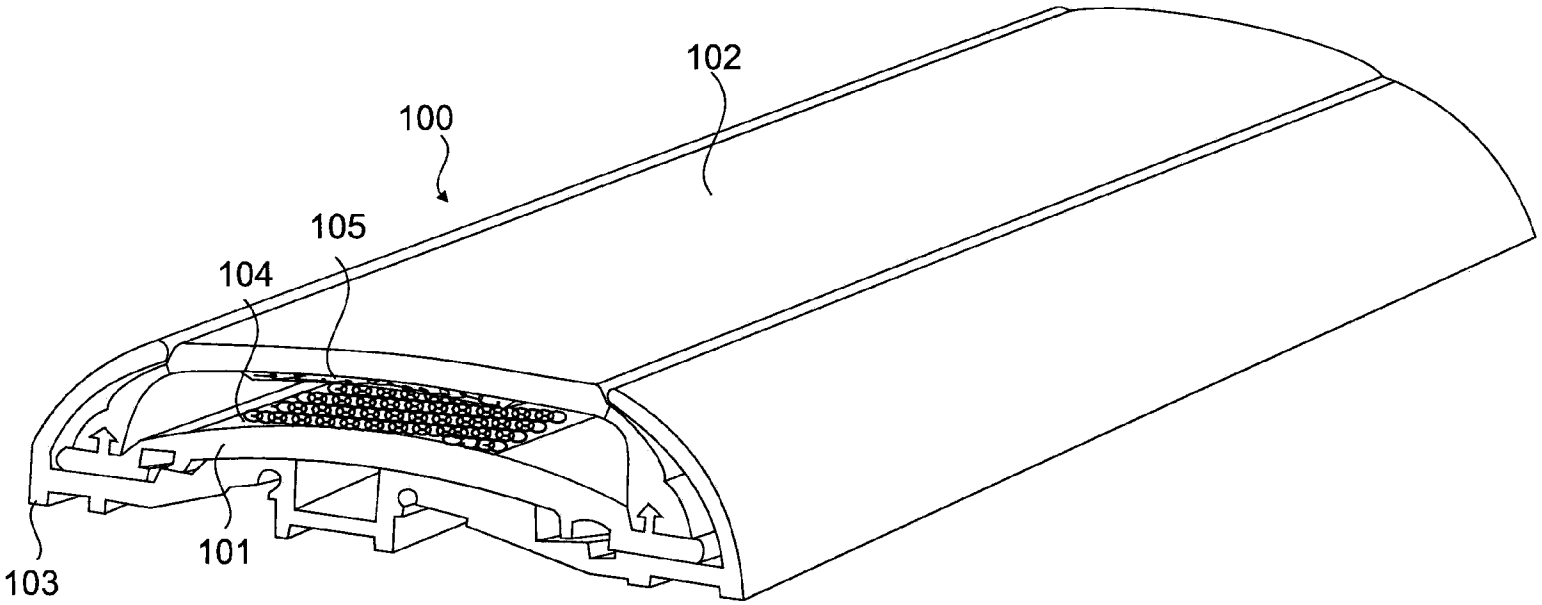
FIG. 1 illustrates schematically in perspective view a cut away view of a first linear contact strip according to a best mode of the present invention.

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

In this specification, whilst the term "switch" has been used to describe activation of an electrical contacting strip, it will be understood that the term "switch" does not necessarily mean a permanent switch from an open electrical circuit state to a closed electrical circuit state. Rather the term can encompass a temporary or instantaneous electrical contact.

In this specification, the term "mesh" is used to describe a sheet of material constructed form a plurality of individual strands, filaments or wires. The mesh may have a loose open structure allowing a plurality of voids or spaces between the individual filaments or twists of filaments. The metal mesh can be woven, knitted, braided, expanded, photo chemically etched, or electro-formed from copper, steel or other electrically conductive metals or metal alloys. The mesh may comprise a gauze of a loose open weave.

There will now be described several different embodiments and variations of an electrical contact strip which can be used as part of an extended press at any point switch device.

A contact strip system according to a specific embodiment disclosed herein comprises one or a plurality of elongate contact strips, one or more terminations, and one or more connectors for connecting individual contact strips, one or more end caps or end covers, one or more internal angle cover caps, one or more flat angled cover caps, and one or more straight connection cover caps.

Best mode embodiments disclosed herein provide for a compressive, or non shearing electrical contact strip comprising a pair of electrically conducting contacts spaced apart across an electrically insulating space or cavity. At least one of the contact strips is connected to a resiliently deformable carrier strip, which enables the electrical contacts to move together under compressive force, so that the two contacts can touch each other and make electrical contact.

In the best mode, the contact strip makes use of an electrically conductive copper knitted mesh embedded in an electrically isolating resiliently deformable material. Use of a conductive metal knitted mesh has an advantage of providing a high resilience to damage, such as cutting or severing, whilst still maintaining electrical continuity. In various embodiments, only the outer strip needs to be a flexible mesh, as this moves or deforms.

A knitted mesh structure consisting of a plurality of interlocked loops provides a plurality of contact positions per loop with neighboring loops. Hence the number of points at which an individual strand of a knitted mesh contacts other strands of the same mesh per unit area, is greater than for a woven mesh covering the same area, in which the warp and weft strands contact each other at their intersections, where the apertures between strand have the same area. The relatively greater number of contact points within the structure of the knitted mesh give better conductivity and better resilience to damage of the knitted mesh compared to a woven mesh. The knit tends to be more open than a weave so there is better light transmission through the knitted mesh. Additionally knits tend not to fray at the edges, and use less material. Also with a knitted sock, the first layer is fully absorbed into the supporting layer, tends to prevent the outer layer of the sock second layer from sinking too far beneath the surface of the co extruded supporting layer, whilst still maintaining strength, and bonding.

Referring to FIG. 1 herein, there is illustrated schematically in cut away view a section of a first contact strip according to a best mode of the present invention. The contact strip 100 comprises a first elongate inner strip 101; a second outer, or cover strip 102 and an elongate mounting strip or base strip 103. The inner and outer strips 101, 102 lie in parallel to the base strip, and the elongate mounting plate or strip 103 holds the first and second elongate strips.

The elongate inner first strip 101 comprises an electrically conducting strip of woven, knitted or braided mesh, extending along its length and facing into a cavity formed between the first inner strip 101 and the second, outer strip 102. The outer strip 102 has, on its inner surface, a second electrically conducting strip of woven, knitted or braided mesh, facing opposite the first mesh strip 104, so that the two conductive mesh strips face opposite each other and are spaced apart along the whole of their lengths, by an electrically isolating gap.

The first and second electrically conducting strips lie substantially parallel to each other and face each other across a void or cavity between the base strip and the cover strip. The inventors have realized that an optimum body shape is an arch or bridge. In the best mode, the first and/or second electrically conducting strips are of knitted metal mesh. In some embodiments, the electrically conducting strips may be formed from a single sheet of metal, suitably stamped out and twisted or bent to provide a surface having many protruding peaks or troughs, extending over a two dimensional area. In other embodiments, the electrical conductor may comprise a web or strip of carbon fiber material.

The elongate mounting plate or base strip 103 is shaped so as to cradle the edges of the inner and outer strips, such that an upper surface of the outer strip is exposed, and can be pushed or pressed by a person, thereby causing the flexible outer strip to deform such that the second conductive mesh travels across the gap in order to contact the first conductive mesh.

On releasing pressure from the outer conductive strip 102, the strip reverts back to its un-deformed state, so that the two conductive meshes no longer contact each other, and electrical connection between the two meshes is broken.

Termination of the strip is provided by an end plate with a cap cover.

Figure 2:
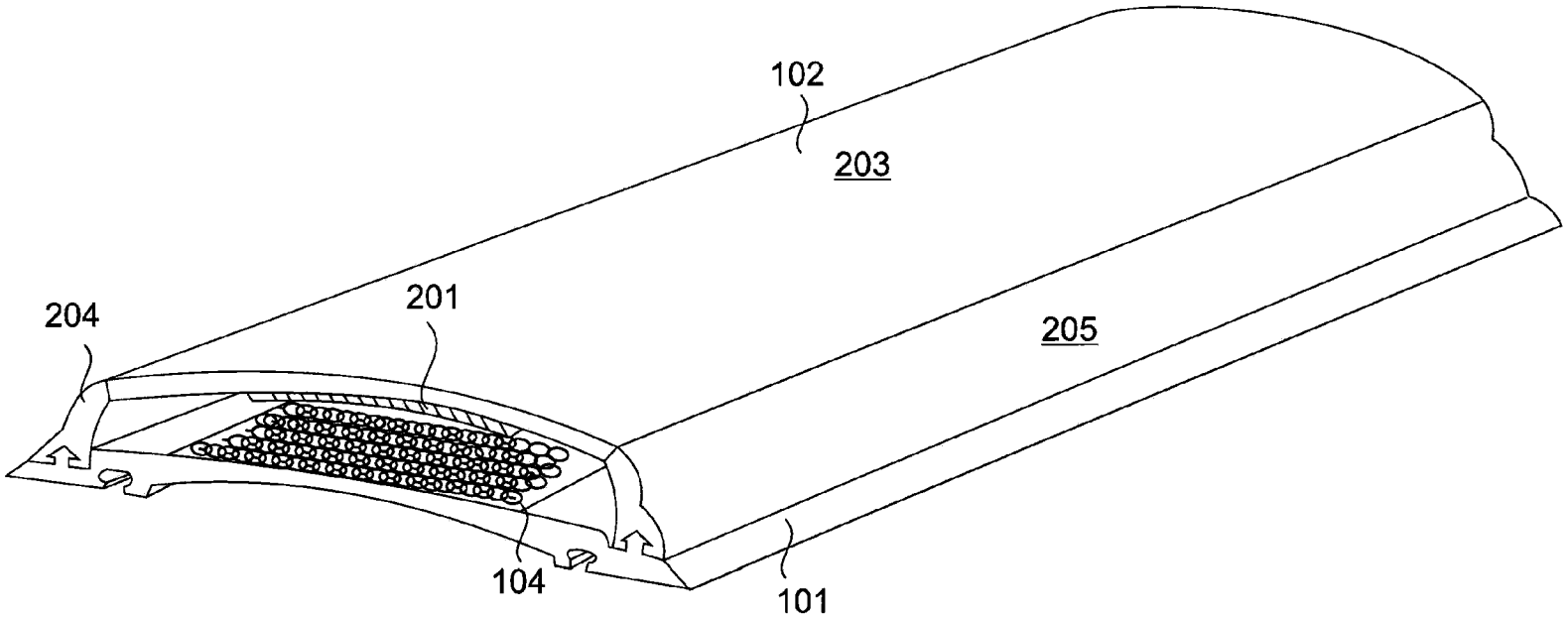
FIG. 2 illustrates schematically in perspective view inner and outer strip components of the first contact strip shown in FIG. 1 herein.

Referring to FIG. 2 herein, there is illustrated schematically in perspective view, a section of the inner and outer strips 101; 102 of FIG. 1 herein. The outer cover strip 102 in cross-sectional view in a direction along a main length of the strip forms a bridge over a central portion of the inner strip 101. The inner strip 101 is provided with a first elongate web of knitted, woven or braided mesh 104, which forms a first electrical conductor. The outer cover strip 102 comprises a second elongate web of knitted, woven or braided metal or conductive mesh 201, which is attached to an inner surface of the cover strip 102. Alternatively other electrically conductive material could be used. The cover strip 102 comprises a central bridge portion, preferably made of a transparent or translucent plastics material such as Poly Vinyl Chloride (PVC), and at each side, a respective first and second nitrile pillars or side walls 204, 205. The bridge portion 203, nitrile pillar 204, 205 and conductive mesh 201 are formed in a single co-extrusion process. The inner strip 101 in the best mode comprises a translucent or transparent PVC material co-extruded with the first conductive mesh 104.

In a best mode, the outer cover strip 102 is formed of a flexible extruded plastics material, which enables the cover strip to be deformed by the application of pressure, for example hand or foot applied pressure, on the strip, so that the second electrical conductor 201 comes into physical contact with the first electrical conductor 104, and thereby makes electrical connection.

The side pillars are manufactured from a flexible and deformable material having good shape memory and will therefore return the attached bridge portion back to its undepressed rest state after being pressed. The shape memory is in all axes of compression, shear, deflection and deformation. The pillars are co extruded from a flexible PVC/nitrile composition, where the percentage of nitrile changes the Shore hardness properties making it softer and increasing its elasticity and compressibility and changing the product's temperature operating range. The properties of the pillar material depend on the mix of PVC and rubber or other material of the pillars. In general, the pillars can be made of the polymers Nitrol, Nitrite or Nitrile, differing in the amount of rubbers or nitriles in the mix. The bridge can be manufactured from a silicon blend which has the properties of good transparency and good temperature range. The use of Silicon places a limitation on manufacture of length, due to the need for a vulcanization process.

As the material of the contact strip is flexible, and has memory shape, pressing the contact strip may lead to a temporary electrical contact between the pair of electrical conductors, which then releases once pressure is removed from the contact strip and the cover strip and base strip resume their previous shape, with a space between first and second electrical conductors of the contact strip.

Figure 3:
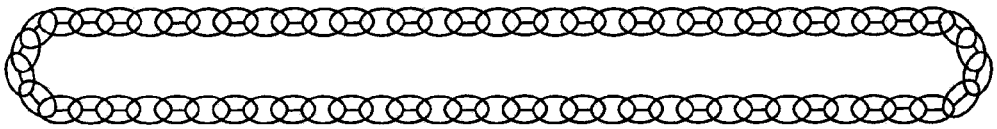
FIG. 3 illustrates schematically in view from one end, a conductive mesh sleeve comprising the first linear contact strip of FIG. 1 herein.

Referring to FIG. 3 herein, there is illustrated schematically in view from one end one embodiment of an elongate tubular metal mesh web 300, used for the first and/or second electrical conductors of the extended contact strip.

The elongate web is manufactured from a multi-stranded or single stranded tinned copper wire which is knitted to form a continuous tubular sleeve or sock. The flexibility of the individual filaments or strands of the sleeve allows the sleeve to be manipulated between an unexpanded and a fully expanded position. The wire filaments are able to move relative to each other as the sock is expanded through its full range of movement. In use, the tubular sock or sleeve is squashed so as to have two parallel sides as shown in FIG. 3, with one of those sides being bonded to the inner strip 101.

Similarly, another mesh tubular sleeve is similarly bonded to the underside of the cover strip 101.

The filaments of the mesh form eyelets or loops, each eyelet being a ring of filament surrounding a void space. As the sock comprises a plurality of individual strands, the failure of any individual strand has no significant effect on the electrical performance of the mesh. Further, as one side of the mesh is almost fully embedded in the PVC material of the supporting strip, the PVC material protects the electrical integrity of the mesh strip/sock, even if some of the strands of mesh which protrude from the PVC surface become severed or damaged.

Under normal operation the inner and outer strips 101, 102 can expand or contract in the longitudinal and lateral directions uniformly and at the same rate as the material of the inner or outer strips, whilst still being able to deform under applied pressure to activate the switch. Since the mesh is flexible, it accommodates movement in three dimensions, and flexes with the normal operational movement of the inner or outer strips without imposing unwanted restrictive forces on the movement of the inner or outer strips. Under heating or cooling, rippling of the inner or outer strips is avoided, and a constant gap is maintained between the inner and outer strips.

Strip Body

Figure 4:
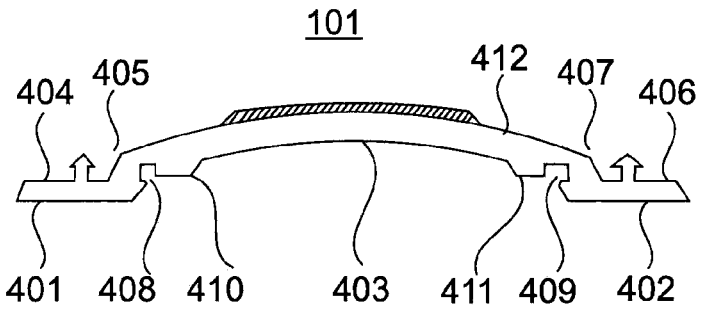
FIG. 4 illustrates schematically an inner strip comprising the contact strip of FIG. 1 herein.
Figure 5:
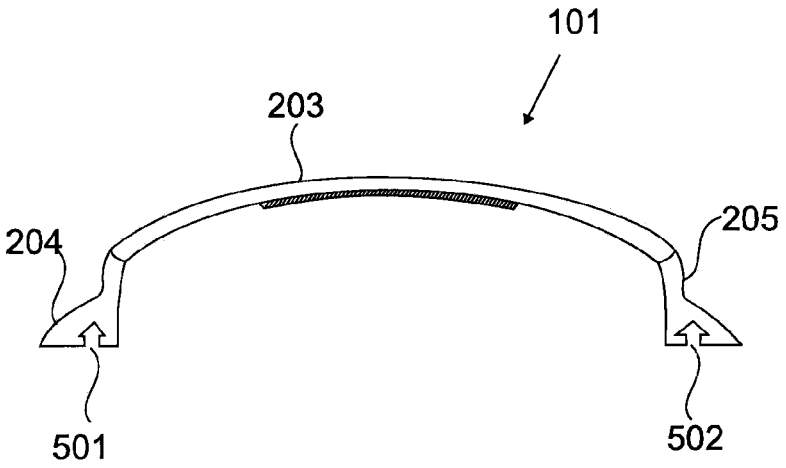
FIG. 5 illustrates schematically an outer strip of the contact strip of FIG. 1 herein.

Referring to FIGS. 4 and 5 herein respectively, in the best mode, the main body of the inner strip and outer strips are extruded components, manufactured for simplicity in two parts with end profiles as shown in FIGS. 4 and 5 herein.

Extrusion is a process in which hot or cold semi-soft solid material such as a plastics material e.g. Poly Vinyl Chloride (PVC), or silicone is forced through an orifice of a die to produce a continuously formed piece in the shape of the desired component. In this case, both the inner strip 101 and the outer strip 102 are each separately formed by extrusion.

However, in an alternative embodiment, both the inner and outer strips can be co-extruded in a single process as a single component, rather than as two separate components.

To bond the metallic tubular sleeve together with the PVC inner strip 101 or outer strip 102 to create an homogenous material comprising a knitted wire sock and the PVC strip requires co-extrusion of the tubular sleeve with the inner strip or outer strip as appropriate. The open stitches of the sock create air gaps, which are filled under pressure of the co-extrusion process with the PVC of the backing strip component or the cover strip component to form a series of PVC material cells each linked by the wire filament.

These PVC cells are constrained by the copper eyelets (i.e. gaps between the stitches) and are encapsulated by the PVC material to form the body shape.

Referring to FIG. 4 herein, there is shown in cross sectional view the elongate inner strip 101. The strip comprises a first lateral substantially planar portion 401 on a first side of the inner strip; a second lateral substantially planar portion 402 on a second side of the inner strip; and a central bridge portion 403 linking the first and second lateral portions.

The central bridge portion is substantially arch shaped, spanning between an inner side of the first lateral portion 401 and an inner side of the second lateral portion 402.

An upper surface 404 of the first lateral portion is substantially flat, and is provided with an upstanding elongate ridge member 405, having in cross sectional profile an arrow shape. Similarly, an upper surface 406 of the second lateral portion is provided with a second upstanding ridge 407, also having a cross sectional profile in the form of an arrow shape.

An underside of the bridge portion 403 is provided with first and second arrow shaped channels 408, 409, on the respective first and second sides of the bridge portion to act as alignment features for use during assembly. The arrow shaped channels are provided, to engage with a pair of arrow shaped ridges or protrusions on a mounting strip, or any other alignment features which can be attached to a wall or other surface, so that optionally the inner strip can be precisely located onto the surface of the mounting strip by inserting the protruding arrow shaped ridges into corresponding arrow shaped channels 408, 409 or other alignment features at the back of the backing strip.

Either side of the bridge portion, between the bridge portion and the lateral portions is provided a respective first and second elongate protrusion 410, 411 which acts as a foot to rest on a corresponding ledge portion of the base plate 103, to retain the inner strip within the base plate.

The central arched portion of the backing strip is deformable and has resilience, such that it has shape memory. An outwardly facing upper surface 412 of the arch portion is co-extruded to an electrically conducting web of conductive mesh as described with reference to FIG. 3 herein.

An under-surface of the central arch portion 403 is spaced apart from a main plane connecting the under-surfaces of the first and second lateral portions, so that when the backing strip is placed on a supporting surface, there is enough room for the flexible arch 403 to depress towards a supporting surface of the base plate 103.

Referring to FIG. 5 herein, there is illustrated schematically in cross sectional view, an extruded component of the outer cover strip 102. The cover strip comprises first laterally extending wall or pillar portion 204 at a first side of the strip; second laterally extending wall or pillar portion 205 at a second side of the strip; and arched shaped roof portion 203 extending between upper portions of the first and second laterally extending side portions. In cross sectional view each wall portion comprises a substantially foot shape, having a substantially planar under-surface. The under-surfaces are each provided with a recessed arrow shaped channel portion 501, 502 respectively. The arrow shaped recesses engage with the corresponding respective arrow shaped protrusions or ridges 405, 407 of the inner strip, and the flat planar under-surfaces of the first and second wall portions correspond with the flat upper surfaces 404, 406 of the first and second lateral portions of the inner strip.

The outer cover strip may be attached to the inner strip by a combination of positive engagement of the arrow shaped ridges or protrusions into their corresponding arrow shaped recesses in the cover strip, together with adhesive between the planar under-surface of the wall portions of cover, and the planar flat surfaces on the outside of the flat planar edge portions of the inner strip.

The recessed arrow shaped channels 501, 502 and the corresponding arrow shaped protrusions or ridges 405, 407 are provided primarily to locate a first side of the inner strip with a first side of the outer strip, and a second side of the inner strip with the second side of the outer strip. The strips may be joined together by a layer of glue, or by one or more welds.

Figure 6:
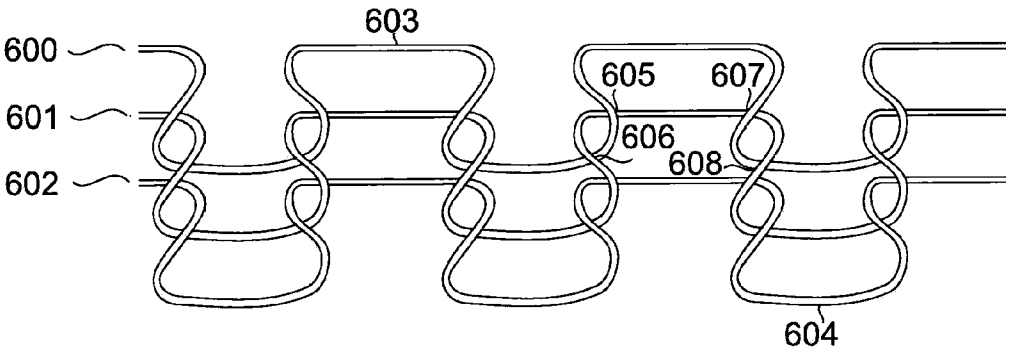
FIG. 6 illustrates schematically a section of knitted metal mesh sock used in the best mode embodiment herein.

Referring to FIG. 6 herein, the effect of compression on the tubular metal sleeve is illustrated. In the best mode, a knitted mesh is described, but in other embodiments the mesh could be woven or braided. A copper mesh is described, but any suitable electrically conductive metal or alloy could be used.

In FIG. 6 there is shown a section of knitted mesh in plan view, consisting of a plurality of strands 600-602 of copper wire. The strands are formed in to loops, with the loops of one strand interlocking with adjacent loops of an adjacent strand. Each loop contacts an adjacent loop at four contact points 605-608, and as the strands move relative to each other, each loop generally maintains contact in a sliding relationship with an adjacent loop of an immediately adjacent strand, ensuring that electrical connection is always present between individual strands, whilst at the same time allowing for a degree of movement and slip between the loops.

In the best mode, the knitted mesh is embedded into the upper surface of the backing strip, or in the case of the cover strip, under the surface of the cover strip. The backing strip and/or cover strip may be formed of a PVC composite material, which has a memory shape, so that when deformed, the material tends to resume its original shape as originally formed. By co-extruding a woven mesh sock together with the composite PVC material of the cover strip (and similarly for the backing strip), the combination of the material of the cover strip, and the knitted copper mesh helps lend resilience to the cover strip (and/or backing strip as appropriate) and helps each of the two strips retain their memory shape. The mesh acts as a reinforcement to the extruded PVC cover strip or backing strip, in each case to help it maintain its originally extruded shape, but also to retain flexibility, over a long working life time, without degradation of flexibility and without degradation of memory shape.

The volume of PVC contained within the boundaries of the loops of the "squashed" knitted tubular mesh increase the overall shape stability and shape memory of the PVC component (cover or backing strip).

Figure 7:
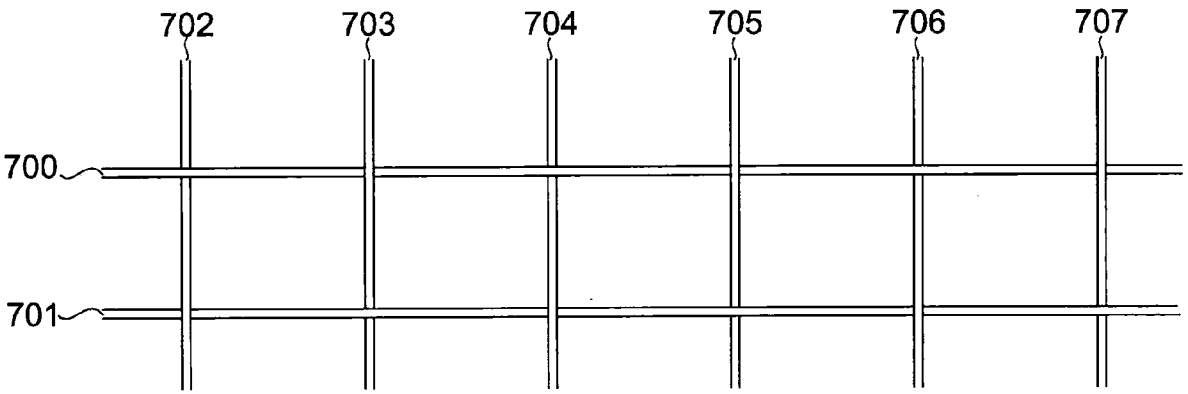
FIG. 7 illustrates schematically a section of woven metal mesh used in an alternative embodiment disclosed herein.

Referring to FIG. 7 herein, there is shown an alternative mesh structure comprising a woven mesh. The woven mesh comprises a plurality of warp strands 700, 701 and a plurality of weft strands 702-707, the weft strands extending in a substantially orthogonal direction to the warp strands, and interleaved therewith.

At the points of intersection between the warp strands and the weft strands, the strands contact each other. In this case, for an equivalent area of mesh as shown in FIG. 6, there are 12 points of contact between the strands, whereas in the knitted mesh of FIG. 6, there are 24 points of contact between the strands. Hence, for an equivalent area coverage, the knitted mesh has a higher density of contacts between strands than a woven mesh, having an approximately similar inter-strand aperture size. Further, since the individual strands of the knitted mesh extend in each of the orthogonal X, Y and Z directions, whereas each individual strand of the knitted mesh extends mainly in an X and Z or a Y and Z direction as appropriate, there are relatively fewer individual strands in the knitted mesh per unit area compared to the equivalent woven mesh of similar dimensions and similar aperture size. In the knitted mesh of FIG. 6, there is shown a section of three strands, which is an equivalent area to the section of woven mesh of FIG. 7 where there are eight strands, for the same number of apertures. The knitted mesh is overall better connected electrically than the equivalent woven mesh, due to its greater number of contacts between strands, and its relatively lower number of strands per unit area.

In either case, both for the knitted mesh and the woven mesh, in general, tension and compression forces are distributed across the mesh, and since the rings of the mesh are constrained by the opposing resistive forces of the resilient PVC material which they surround, the overall effect is to enhance memory shape of the PVC backing strip component and the PVC cover strip.

Construction

Figure 8:
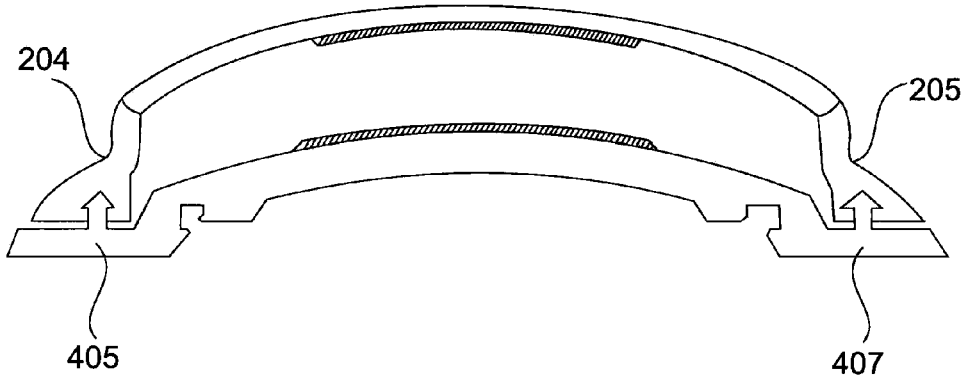
FIG. 8 illustrates schematically the inner and outer strips connected together.

Referring to FIG. 8 herein, there is illustrated schematically in cross sectional view, the inner strip and cover strip assembled to each other. The edge pillars 204, 205 of the cover strip clip to the raised protrusions 405, 407 of the backing strip. Additionally, the pillars of the cover are bonded to the planar sections of the backing strip, in order to prevent the ingress of moisture, and to achieve the required ingress protection rating. The different material of the lateral pillars compared to the roof portion are shown as different shadings.

A preferred method of bonding the cover strip to the inner strip is to use an ultra-violet sensitive adhesive or a cyanoacrylate adhesive. However, other methods of bonding PVC can be used.

Whilst the use of adhesive bonding is preferred, the cover strip and inner strip can attach to each other without the use of bonding, and the contact strip can be installed and operated without the use of bonding.

Figure 9:
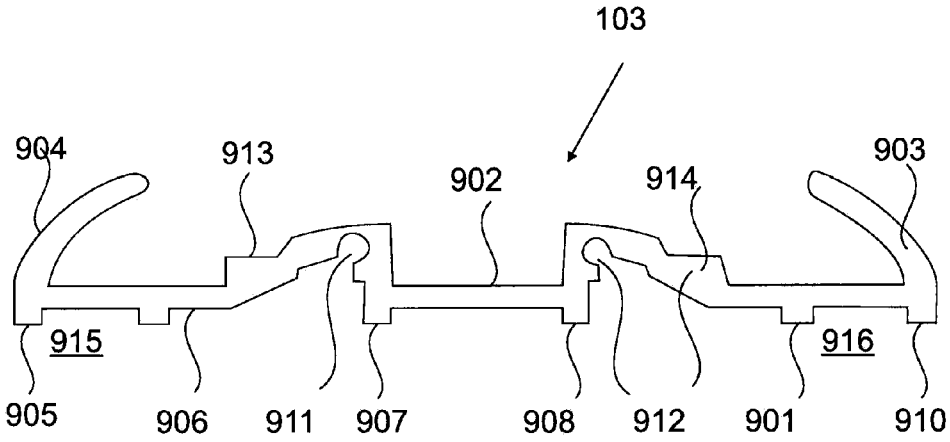
FIG. 9 illustrates schematically a base strip for holding the inner and outer strips of FIG. 8.

Referring to FIG. 9 herein, there is illustrated schematically in cross sectional view the elongate cradle or mounting strip 103 which is used to hold the flexible inner strip and cover strip assembly in situ on a wall or other surface. The cradle also provides a central channel, into which a lighting device, such as a string of light emitting diodes or a fiber optic cable, can be installed.

The purpose of the cradle is to provide a means to fix the contact strip to a structure such as a wall or floor, and to act as a cradle to stop the inner and outer strips from being removed once installed.

The cradle comprises a rigid aluminum extrusion having a floor portion 901, the floor portion having a central channel 902; a first arcuate elongate wall 903 on a first side of the cradle; and a second arcuate wall portion 904 on a second, opposite side of the cradle.

The arcuate wall portions are shaped so as, in use, to enclose the inner strip 101 and the lateral pillars of the cover strip 102, such that the resultant exposed external surface comprising the arcuate wall portions, and the roof of the cover strip form a smooth substantially continuous surface.

An underside of the cradle, which is intended to contact and abut a surface to which the contact strip is to be attached to, comprises a plurality of ridges 905 to 910, intended to seat on the supporting surface.

An upper surface of the floor portion 901 is shaped so as to closely match and support an under-surface of the inner strip 101. On the underside of the cradle, are provided a pair of part cylindrical channels 911, which act as alignment channels for fitting lengths of the together.

In cross sectional view, the mounting strip 103 has a pair of elongate ledges or shelves 912, 913. The purpose of these ledges is to retain an underside of the inner strip 101 within the cavity surrounded by a base portion of the mounting plate and the side walls of the mounting plate, so that the relatively flexible inner strip 101 and outer cover strip 102 cannot be pulled out of the mounting plate 103 using a persons bare hands, and also to provide some resistance against levering the inner strip and outer cover strip out of the mounting plate using an implement such as a screw driver or knife.

The pillars may behave differently depending on whether they are constrained or unconstrained by the side walls. Where the outer and inner strip are constrained, the pillars act primarily in compression and when the bridge portion is depressed, and the edge portions 401, 402 of the inner strip remains constrained by the outer walls of the mounting strip.

However, where the outer and inner strips are unconstrained by the mounting plate, for example if the outer and inner strips were to be used without the mounting strip, then the pillars would act more in a manner of a shear.

Figure 10:
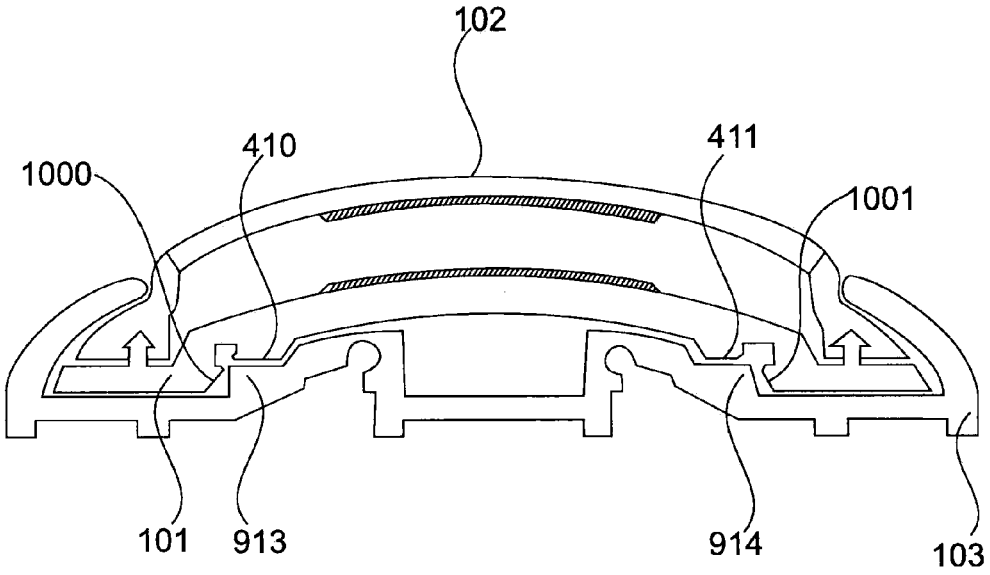
FIG. 10 illustrates schematically in cross sectional view from one end the contact strip of FIG. 1 in assembled form.

Referring to FIG. 10 herein, there is illustrated schematically in cross sectional view from one end, the fully assembled contact strip comprising the mounting strip 103, the backing strip 101 and the cover strip 102.

In a preferred embodiment, the mounting strip has a width from edge to edge of the order of around 60 mm. A height of the cover strip above the surface to which the contact strip may be mounted is preferably of the order of 15 mm to 20 mm. A width of the internal central channel of the mounting strip is preferably of the order of 10 mm to 11 mm. A clearance distance between the underside of the roof of the cover portion, and the arched portion of the inner strip is preferably of the order of 2 mm to 5 mm, to provide electrical isolation and functional sensitivity. By varying the gap or arch length, a greater or lesser functional sensitivity can be achieved.

The combined inner strip and cover strip assembly is inserted into the mounting strip, by flexing the inner strip and cover strip together once they have been connected together. The arrow or claw shaped ridges on the inner strip which engage the arrow shaped channels or grooves on the cover strip keep the components together during flexing.

The tubular strip comprising the inner 101 and cover 102 strips may be inserted into the mounting strip 103 sideways, by inserting one side of the inner strip/cover strip assembly into one side of the aluminum mounting strip extrusion, bending or deforming the inner strip/cover strip assembly and inserting the other side under the opposite side of the mounting strip. When fitted, the arched portions on each side of the mounting strip give strength to the cover strip where the central portion of the upper strip is relatively rigid compared to the nitrol side pillars, the nitrol side pillars provide the flexibility and allow the cover strip 1000 to come into contact with the inner strip 1001. The shape of the sides of the inner and cover strips locks them into the sides of the metal or plastics mounting plate 103, and the cradle shape formed by the mounting strip enforces the shape of the flexible strip assembly.

If a person attempts to pull the outer strip out of the mounting plate 103, the elongate feet portions 410, 411, and inner side wall portions 1000, 1001 lock against the protruding elongate ridges or steps 913, 914 respectively and prevent a person from being able to manually pull out the outer or inner strip from the mounting plate 103. Rotation of the outer and inner strips due to pressure on the top of the outer strip tends to rotate the edges of these strips, driving them into the step portions 913, 914 and making it more difficult to remove the strips from the mounting plate 103. Removal of the inner and outer strips from the mounting plate 103 requires access to the end of the contact strip, to lever the end of the inner and outer strips from the mounting plate, from which the inner and outer strips can then be pulled all the way along the mounting plate. This means that the inner and outer strip cannot be removed from the mounting plate without access to the open ends of the contact strip, and therefore avoids persons pulling out the inner and outer strips and using them as a weapon when used in police, or psychiatric cell applications.

Usage

In use, pressure applied from any direction along the active outer surface, i.e. being the roof of the cover strip, causes the roof of the cover strip to deform and the mesh contact underneath the roof, to make contact with the mesh web on the upper surface of the arch of the inner strip, thereby making electrical contact. The electrical contact between the two conductive mesh webs can be used to activate a switch.

The strip can be struck at an angle of up to 70° from a direction perpendicular to the main plane of the mounting strip, and will be triggered by strikes from a wide range of directions.

Pressure applied to the cover strip is distributed in a similar manner as would a load be distributed in the span of a bridge by deflection in the beam, and load is transmitted to the arcuate rigid side walls of the rigid mounting strip. The joints between the cover strip and the inner strip experience a turning motion, but the flexible cover strip and inner strip are held by the arcuate side portions 903, 904 of the mounting strip. The stepped portions 912, 913 isolate the central arched portion of the backing strip from the turning moments transmitted from the cover strip.

In one variation of the contact strip, the strip is designed to be activated by the application of 1 kN of force. By changing the composition of the material of the roof portion, the amount of force needed to activate the switch can be increased or decreased and hence the sensitivity of the strip can be varied by design.

In use, the strip may be installed around the perimeter of a room, for example an interview room, hospital emergency department, police custody cell, disabled washroom/WC, secured accommodation, or a prison room or the like to provide a continuous contact strip which can be activated by striking or pressing the strip at any position along its length.

In other applications, the strip may be used as an elongate contact strip to detect for example a closing window, shutter or garage door. The strip may find use in any application where an elongate contact strip is needed where immediate access along a length of a strip is required, including but not limited to emergency situations.

In some applications, the strip may also provide position detection of the person activating the strip. Electronic circuitry may be applied to one end of the strip to detect the resistance of the strip. Since the resistance of the strip is directly proportional to its length, by electronically measuring the resistance of the strip, the position along the strip at which it has been activated can be calculated. In this respect, specific embodiments herein using a wire mesh have a relatively higher resistance per unit length than prior art embodiments having a flat copper strip, and therefore the embodiments presented herein may give higher resolution and more accurate position information than prior art devices.

Termination

Referring to FIGS. 11 to 15 herein, there is illustrated schematically an end termination to the contact strip described herein above.

The end termination comprises an end plate 1100 and a cover 1200. The end plate may be a plastics molding or an aluminum casting. The end plate has a tongue 1101 which is inserted into the void between the arch of the backing strip and the roof of the cover strip. The tongue has two electrical contacts arranged to make contact with the metal mesh webs on each side of the cavity between the backing strip and the cover strip. The two contacts terminate by respective first and second screw connectors 1102, 1103 which can be connected to electric wire conductors leading to an electronic control.

To facilitate connection to external wiring, monitoring the continuity of the switch is achieved via a terminating resistor connected to a simple bridge circuit.

At either side of the end termination are provided first and second locating lugs 1104, 1105 respectively which locate with first and second channels, 914, 915 respectively on the underside of the cradle.

The end plate 1100 is covered by a cap 1200, which can be of plastics or metal. A range of caps may be provided which all fit the end plate, but which provide the ability to change direction to accommodate the installation of the contact strip in either direction. The caps clip to the end plate, and are designed to be moisture resistant and to give protection against ingress of liquid.

Figure 11:
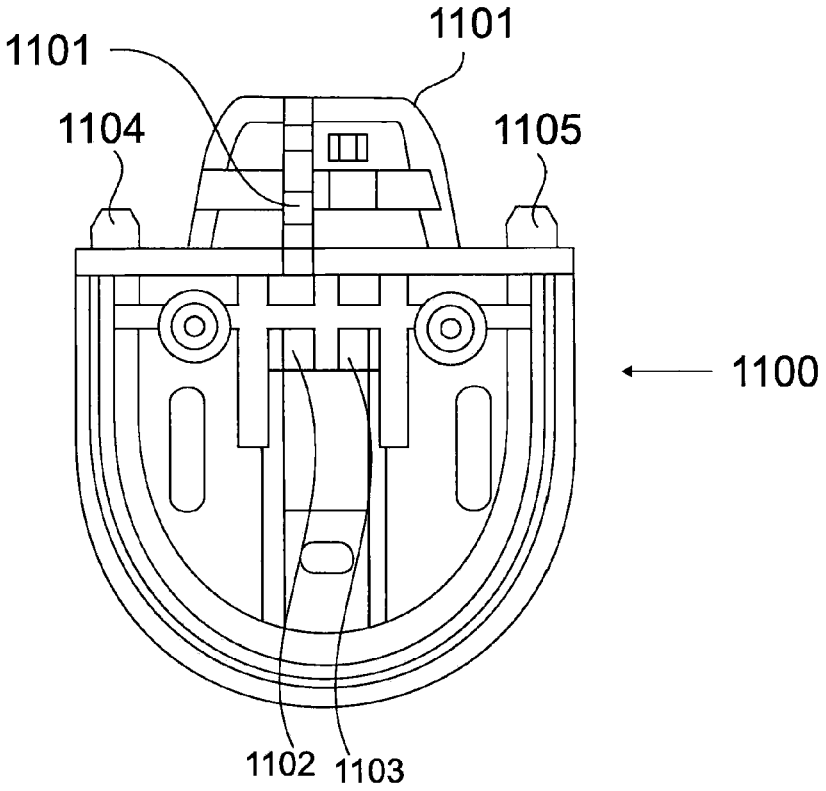
FIG. 11 illustrates schematically in view from above, an end plate of the contact strip of FIG. 1.
Figure 13:
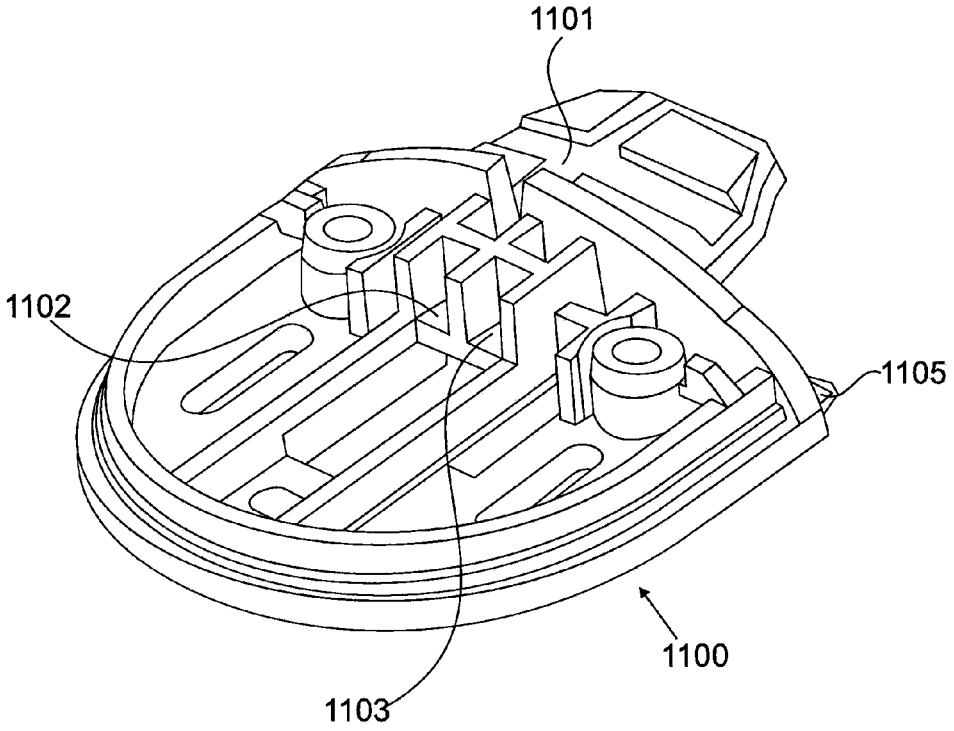
FIG. 13 illustrates in perspective view, the end plate of FIG. 11.

Referring to FIG. 13 herein, there is shown the end plate of FIG. 11 in perspective view.

Figure 14:
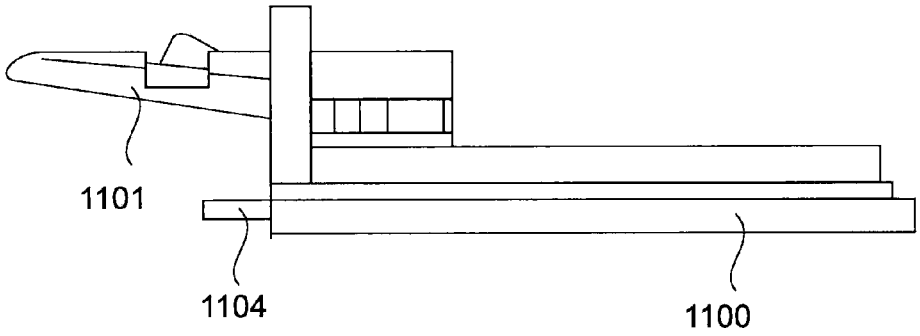
FIG. 14 illustrates the end plate of FIG. 11 in view from one side.

Referring to FIG. 14 herein, there is shown the end plate of FIG. 11 in view from one side.

Figure 15:
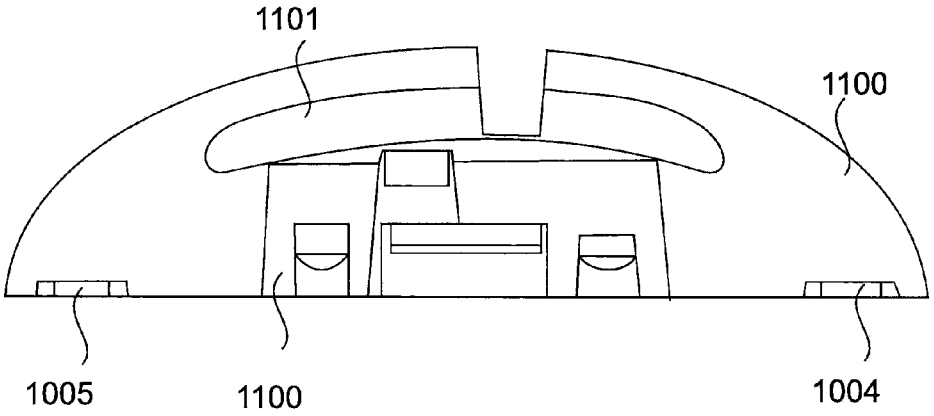
FIG. 15 illustrates the end plate component of FIG. 11 in view from one end.

Referring to FIG. 15 herein, there is shown the end plate of FIG. 11 in view from one end.

Illumination

A light source may be provided within or on the mounting strip, or within or on the outer strip. The light source illuminates the contact strip internally and can be used to signify the electrical or operational status of the strip. The light source shines through the inner and outer strips, the PVC material of which is translucent or transparent. The light is visible through the material of the inner and outer strips, and through the conductive mesh contacts of each of the inner and outer strips.

One advantage of the present embodiment over prior art "press at any point switches" is that the whole of the active externally presented face of the strip, that is the roof portion, is able to be illuminated without significant obstruction from the elongate electrical contacts, since the electrical contacts have voids through which light can pass.

The light source can be a series of light emitting diodes positioned along the central channel of the mounting strip. In alternative embodiments, the light source may be one or more fiber optic cables extending along the length of the channel, or one or more electroluminescent strips in the mounting plate, or it can be electroluminescent paint on the inside of the mounting strip. Therefore, the light source may either be a series of individual point light sources for example, in the case of light emitting diodes, or an extended distributed light source, for example in the case of a fiber optic, or an electroluminescent light tape. In yet a further embodiment, an electroluminescent light tape may be applied on the outside of either the outer strip or the visibly exposed parts of the mounting strip so that the illuminating parts of the contact strip product are on the outside of the device. The light source may be configured to light up when a switch has been activated by pressing the strip.

Where light emitting diodes are used as the light source, the viewable beam angle may be typically around 120°. For example, a light emitting diode positioned in the channel may provide a visible light spot of the surface at the cover strip of diameter around 12 mm, where the light emitting diode has a beam angle of 120°.

Figure 12:
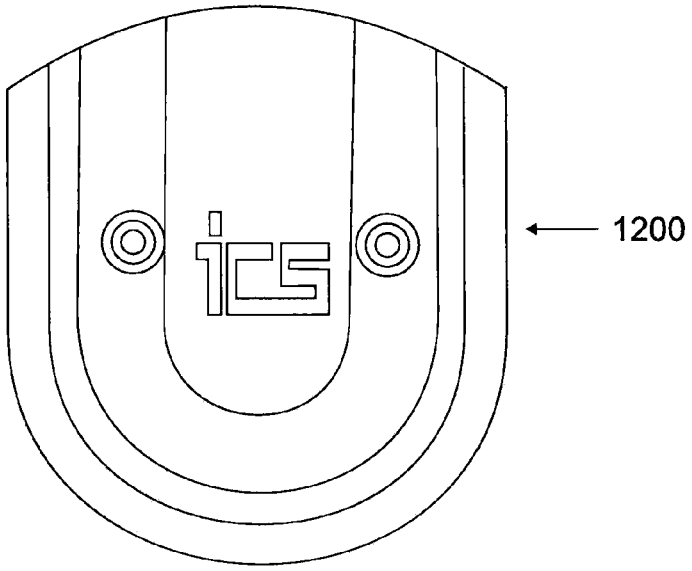
FIG. 12 illustrates in plan view, a cover for the end plate of FIG. 11.
Figure 16:
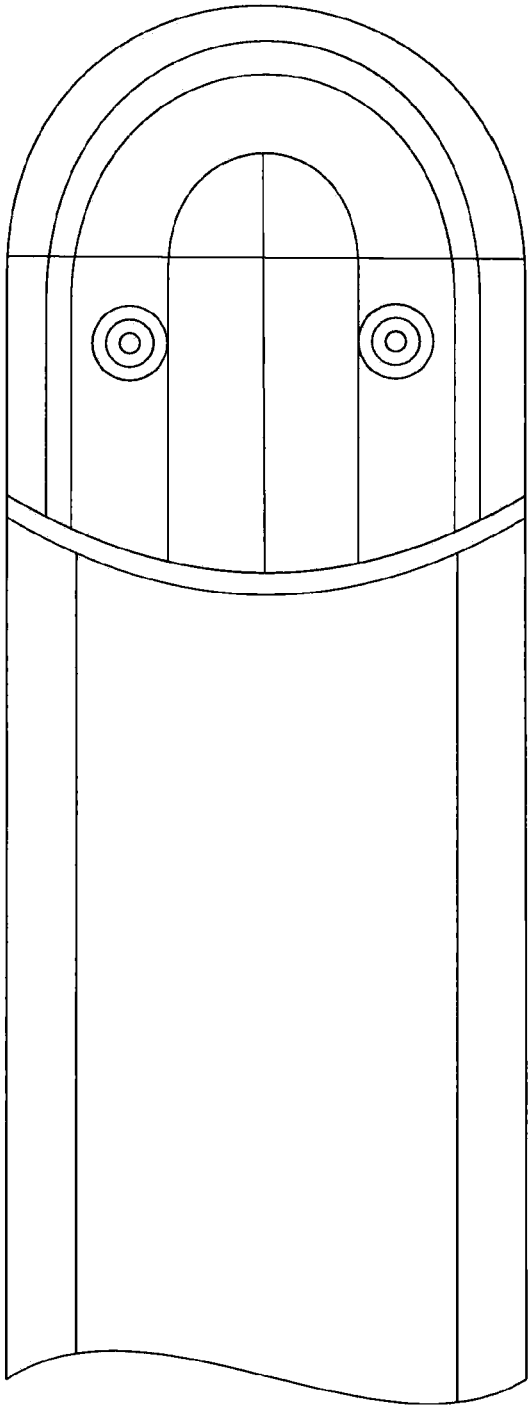
FIG. 16 illustrates schematically a section of the contact strip of FIG. 1 terminated by an end plate as shown in FIGS. 11 to 15 herein.

Referring to FIG. 16 herein, there is illustrated schematically a section of one end of the contact strip of FIG. 1, terminated by an end termination as described with reference to FIGS. 11 to 15 herein. The end termination neatly rounds off the end of the contact strip and has a cover plate as shown in FIG. 12, which is smooth and domed and resistant to vandalism.

Figure 17:
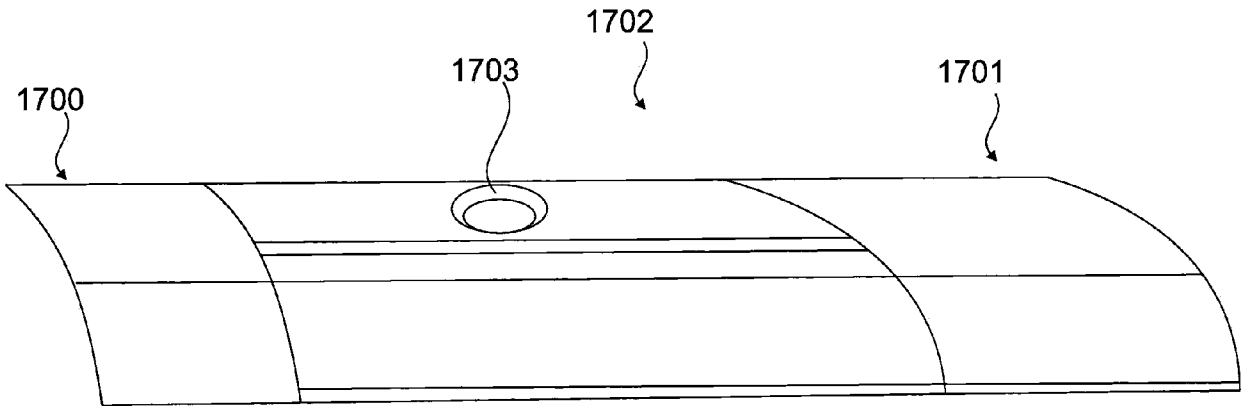
FIG. 17 illustrates schematically two sections of contact strip as shown in FIG. 1, connected end to end by two end plates, and covered with a linear cover strip.

Referring to FIG. 17 herein, there is illustrated schematically first and second contact strips 1700 and 1701 as described herein before connected in end to end manner by a pair of end plates as described with reference to FIGS. 10 to 15 herein, and covered with a linear cover strip 1702.

Showing externally is visible bright spot 1703 provided by a light emitting diode.

The light spot is shown centrally in the flexible transparent or translucent roof of the cover strip.

The inner strip and cover strip may each be formed from flexible PVC, including a plasticizer, giving the PVC a rubber like elasticity and/or pliable texture.

Modification of the degree of transparency of the PVC backing strip and cover strip by the use of compounding agents to modify the haze value of the PVC would be known to those skilled in the art. Similarly, the amount of plasticizer to include in the PVC backing strip and cover strip to achieve the optimum values for toughness and flexibility of the backing strip and cover strip will be known by those skilled in the art.

Where the outer strip is to be transparent or translucent, transparent PVC, low grade nitrols, or silicone are preferred material, but any transparent or translucent material which is extrudable could be used.

Figure 18:
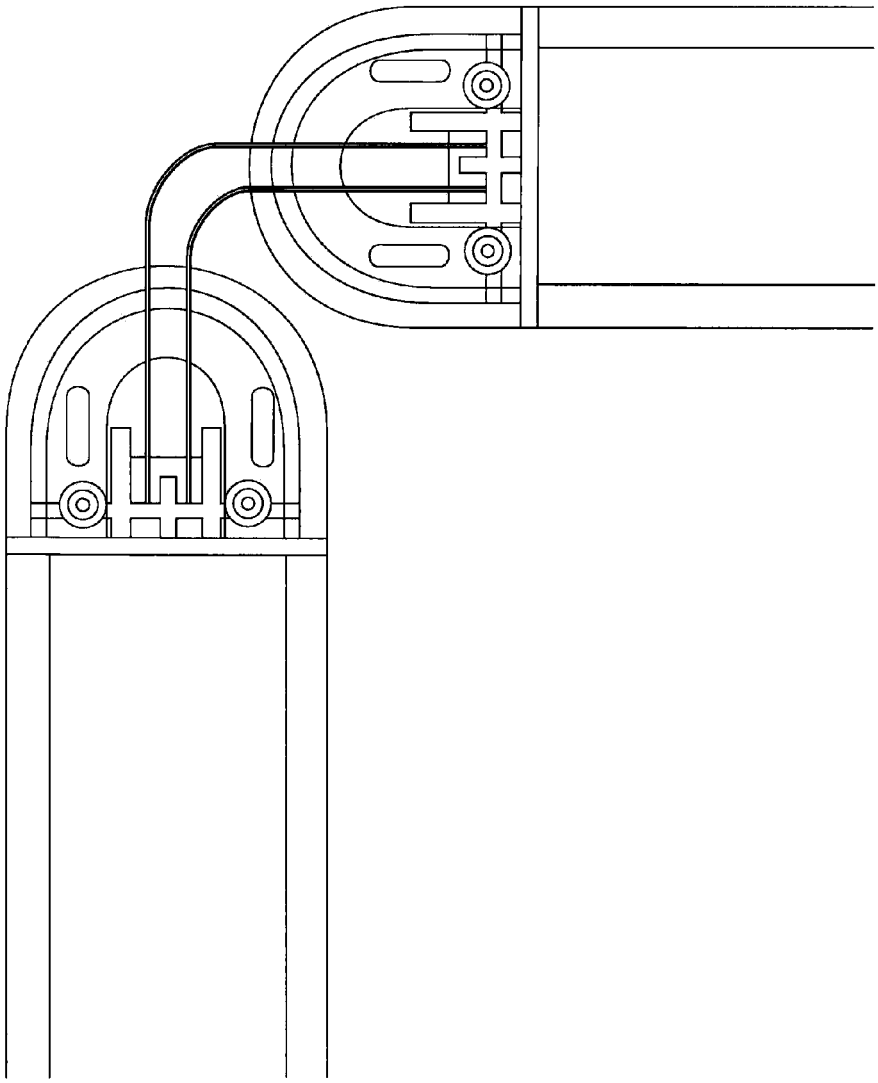
FIG. 18 illustrates schematically a connection of two contact strips of FIG. 1 herein connected through a 90° angle, with the end plates exposed.

Referring to FIG. 18 herein, there is illustrated schematically a pair of contact strips as described with reference to FIG. 1 herein, connected in a 90° angle configuration on a wall or surface. Each contact strip is terminated by an end plate 1801, 1802 respectively, which is secured to a wall or other surface, and connected by electrical conductors 1802, 1803 to maintain electrical continuity between the mesh conductors of the respective separate contact strips.

Figure 19:
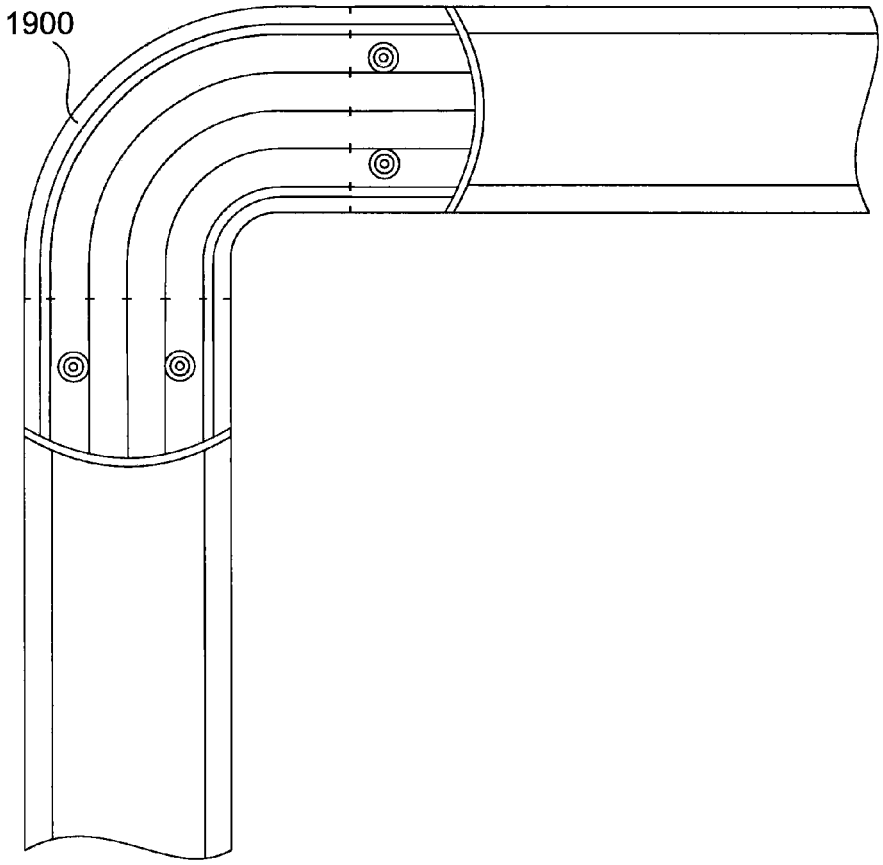
FIG. 19 herein illustrates the two contacts strips of FIG. 18, with a right angle cover cap fitted over the end plates.

Referring to FIG. 19 herein, there is shown the arrangement of FIG. 18, having in place a cover plate 1900. The cover plate provides protection from vandalism to the end plates, the cover having rounded edges and a domed surface, which is difficult for a person to detach from the wall, without the use of tools.

Figure 20:
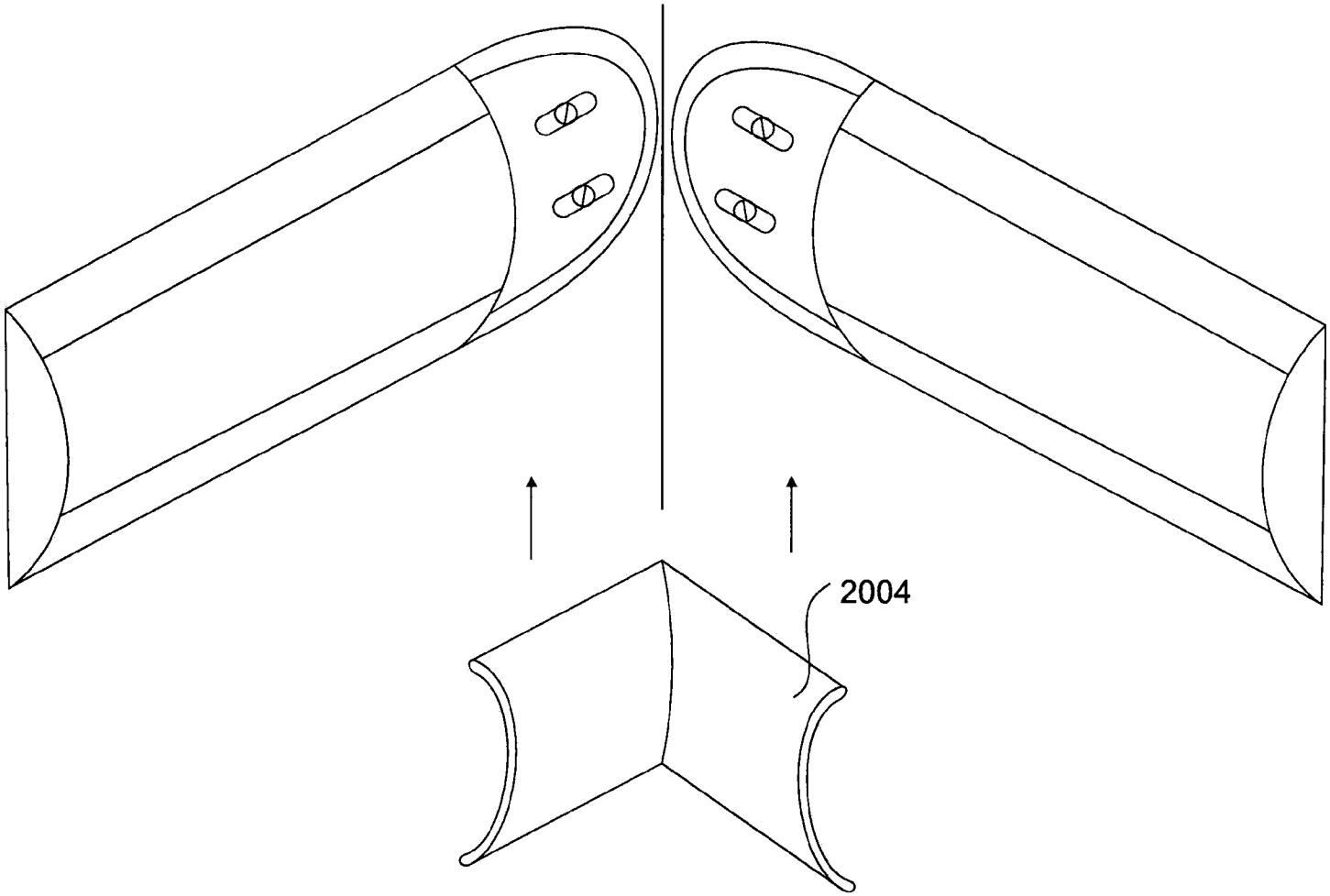
FIG. 20 herein illustrates schematically connection of two lengths of contact strip as shown in FIG. 1 herein, each terminated by an end termination plates, and with an internal angle cover cap covering the end plates.

Referring to FIG. 20 herein, there is illustrated schematically in perspective view, an internal 90° angle of a room, having a pair of contact strips 2000, 2001 as described herein before with reference to FIG. 1, fitted around the room. The contact strips are joined by a pair of end plates 2002, 2003, and connected together electrically by a pair of conductors extending between the end plates, thereby electrically connecting the mesh conductors of the respective separate contact strips. The installation is finished off by an acutely angled cover plate 2004 which secures over the end plates, and is of a shape which is curved, and difficult for a person to vandalize, without the use of tools.

Alternative Embodiments

Figure 21:
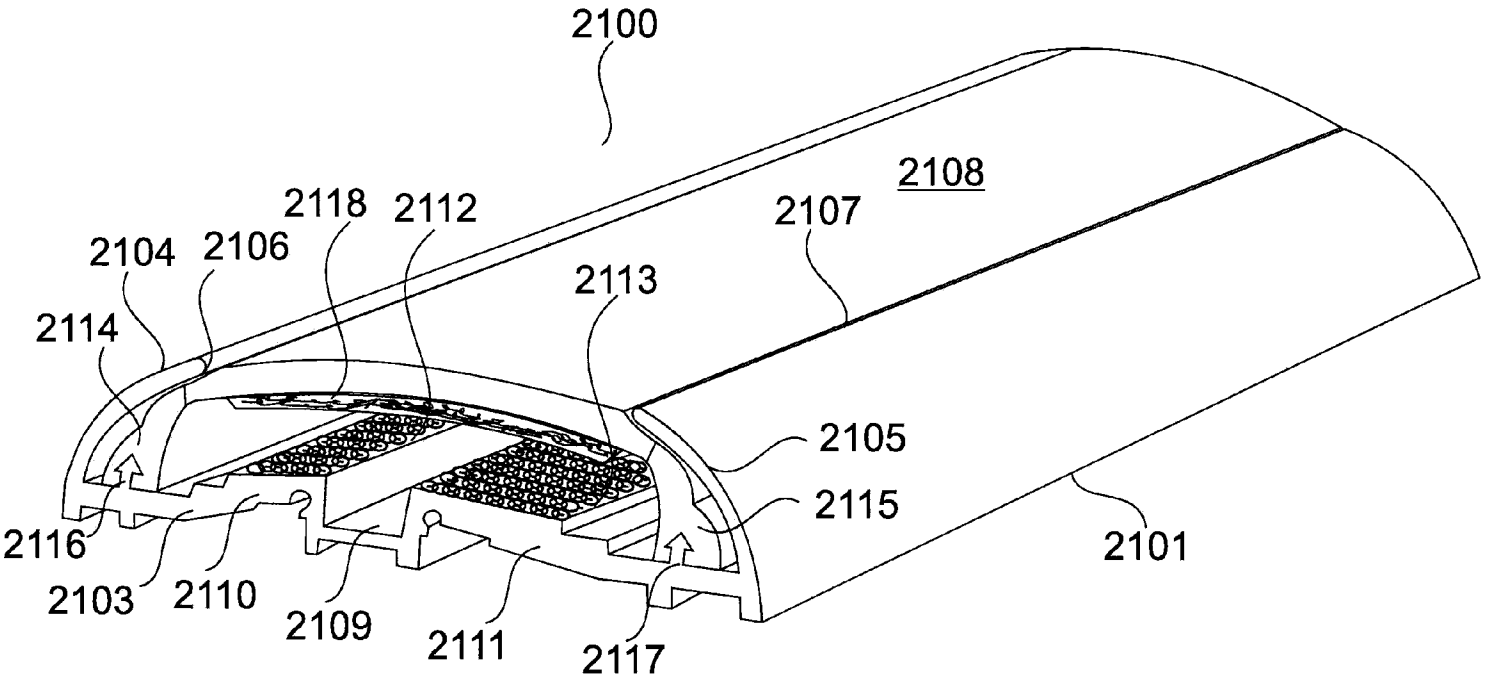
FIG. 21 herein illustrates schematically a second contact strip according to a second specific embodiment.

Referring to FIG. 21 herein, there is illustrated schematically in perspective cut away view, a second contact strip 2100 according to a second specific embodiment.

The second contact strip comprises an extruded aluminum base plate 2101; and an elongate cover strip 2102, which locates within the elongate base plate.

The base plate 2101 comprises a base portion 2103, and a pair of curved opposing side walls 2104, 2105 positioned respectively along each of the opposite edges of the base portion 2103. The side walls follow the curve of an arc, extending over the base portion, and inwardly towards the centre of the base plate, there being a gap between the inner most edges 2106, 2107 of the side walls, into which an outwardly facing upper surface 2108 of the cover strip locates.

The base portion 2103 contains a central channel 2109 into which an elongate illuminating device such as for example a fiber optic cable, or a chain of light emitting devices may be located, so as to illuminate the cover strip from underneath. The base plate comprises a pair of raised elongate platforms 2110, 2111 respectively spaced apart from each other with the channel 2109 there between. Each raised platform is provided with an electrically insulating covering layer, and on top of each electrically insulating covering layer, there is provided a respective elongate electrically conductive mesh 2112, 2113. The mesh can be woven, knitted or braided, from a plurality of strands of conductive material, for example copper wire. In a variation of the second embodiment, the electrically conductive mesh can be formed as a printed patterned conductor, or as a conductor having three-dimensional surface undulations, to provide a series of peaks and troughs which extend into a cavity between the base plate 2101 and the cover strip 2102. In the best mode, each mesh comprises a knitted copper wire mesh tubular sock embedded into an insulating plastics substrate, on top of the platform surfaces 2110, 2111 of the extruded aluminum base plate 2101.

The cover strip 2102 comprises a transparent or translucent roof portion 2108, which extends as a bridge, between a pair of resiliently deformable pillars or hinges 2114, 2115 respectively either side of the roof portion. In the best mode, the pillars are made of nitrile, which is co-extruded with the material of the roof, which in the best mode is Poly Vinyl Chloride (PVC).

The nitrile pillars or hinges may locate within the base plate 2101 on a pair of elongate upright ridges 2116, 2117 respectively, each of which locates with a corresponding respective shaped groove in the base of the respective nitrile pillar. The upright ridges provide secure location for the pillars, and provide resistance to a person levering the cover 2102 out of the base plate. They may also provide sealing against moisture ingress into the cavity between the conductive mesh contacts within the cavity.

An undersurface of the cover 2102 is provided with an elongate tubular conductive mesh, which is co-extruded with the material of the cover so as to form a double layer conductive mesh embedded in the roof of the cover. The conductive mesh faces inwardly opposite the two layers of conductive mesh 2112, 2113 respectively on the base plate, so that as the flexible cover is depressed by a user, the conductive mesh on the outer cover makes contact with one or both of the conductive mesh strips on the base plate. By connecting one or both of the lower conductive meshes 2112, 2113 to a first electrical terminal, and connecting the upper conductive mesh 2118 to a second electrical terminal, an electrical circuit can be completed by depressing the upper surface of the upper cover strip 2102, and thereby use the contact strip as an electrical switch.

The second embodiment contact strip provides a two component contact strip, without the need for a flexible inner strip as provided in the first embodiment described herein above.

In the first and/or second embodiments, the light source may be activated to light up when the contact strip is activated, in order to signify that the switch has been triggered. Alternatively, the light source can be permanently on, so as to illuminate the contact strip permanently, so that it is visible for example in the dark. Electronic circuitry can be provided such that once activated, the light source flashes on and off to signify that the contact strip has been activated and/or that an alarm has been triggered.

In the second embodiment, the light source may be a string of light emitting diodes, a fibre optic, or an electroluminescent strip as for the first embodiment.

Manufacture

Figure 22:
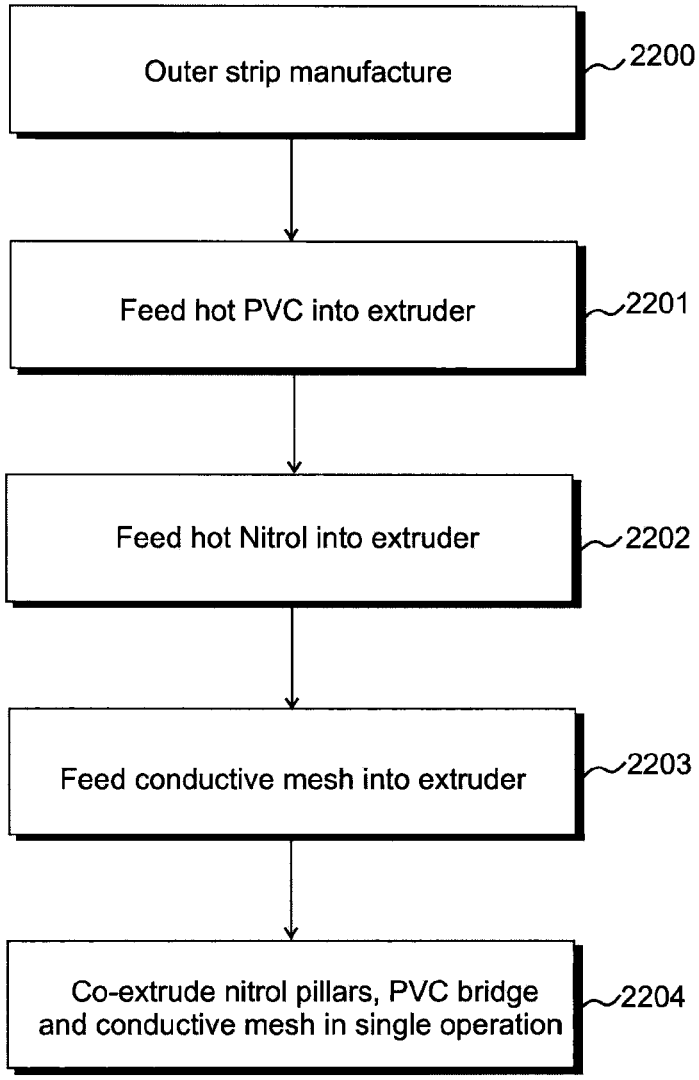
FIG. 22 illustrates schematically process steps for manufacture of an outer strip as disclosed herein.

Referring to FIG. 22 herein, there is illustrated schematically process steps for manufacture of an outer strip as shown in the first embodiment.

In process 2201, a supply of hot PVC is forced through a die and extruded out of the other side of the die. At the same time in parallel process 2202, on either side of the PVC supply are fed first and second hot nitrile supplies, into the same die. The die has the cross sectional shape of the outer strip 102. In parallel with the hot PVC feed and hot nitrile feed, a conductive wire mesh is fed into the extruder, substantially centrally to align with the PVC supply.

The combined extrusion process 2204 co-extrudes the nitrol pillars either side of the PVC bridge, into which is formed an upper part of the conductive mesh in a single operation.

Figure 23:
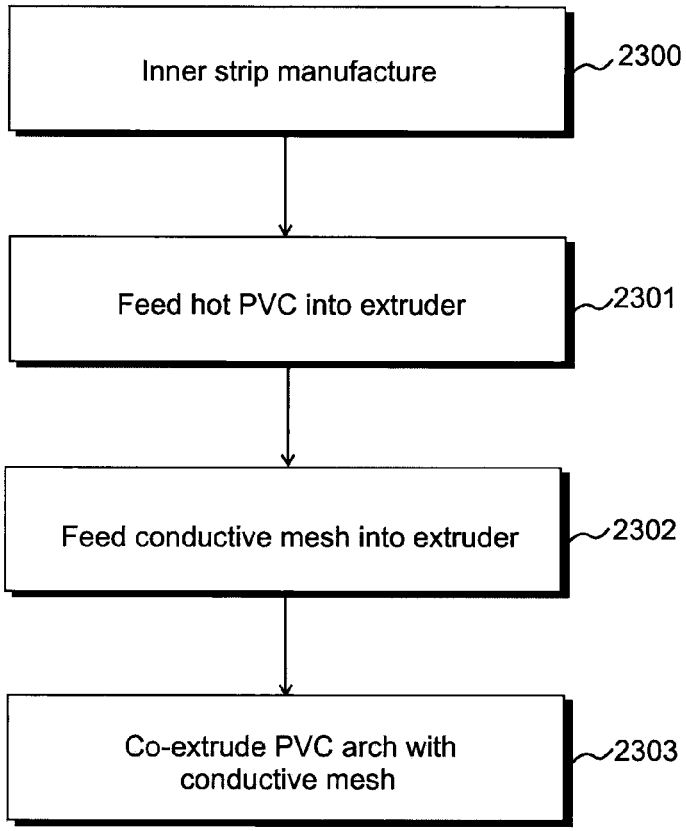
FIG. 23 discloses process steps for manufacture of an inner strip as disclosed herein.

Referring to FIG. 23 herein, there is illustrated schematically manufacture processes for the inner strip of the first embodiment. In process 2301, a hot PVC supply is fed into a die having the cross sectional shape of the inner strip as shown in FIG. 1 herein.

In process 2302, a conductive mesh is fed through the die, at the same time and at substantially the same rate as the PVC supply. The combined PVC body and conductive mesh are co-extruded by passing them through the die together in process 2303.

Figure 24:
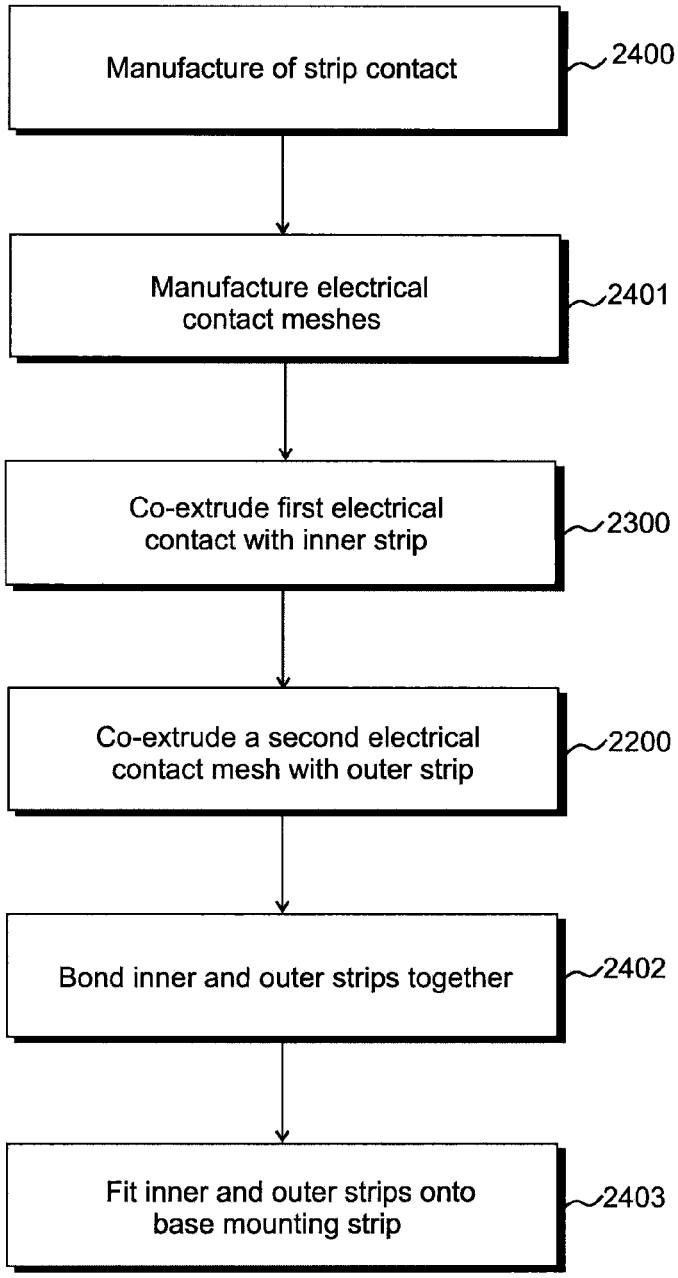
FIG. 24 illustrates schematically the manufacturing process steps for manufacturing of a contact strip as described herein.

Referring to FIG. 24 herein, there is illustrated schematically processes for manufacture 2400 of the contact strip of FIG. 1, comprising the inner and outer strips.

In process 2401, a conductive mesh sock is manufactured. In the best mode, this is tin coated copper wire knitted mesh. In process 2300 previously described, a continuous stream of electrical mesh sock is co-extruded with the PVC material of the inner strip. In process 2200 as previously described, a conductive mesh is co-extruded with a PVC bridge and nitrol pillars, in the best mode, to form the outer strip.

In process 2402 the inner and outer strips are bonded together by gluing the bases of the nitrol pillars to lateral portions of the inner strip and locating the protruding ridges either side of the inner strip into corresponding recessed channels in the nitrol pillars, with the addition of glue. In process 2403 the combined inner and outer strip (the contact strip) is fitted into the metal or plastics mounting plate 103, by bending the strip and feeding the edges of the strip under the side wall portions of the mounting plate strip 103.

Figure 25:
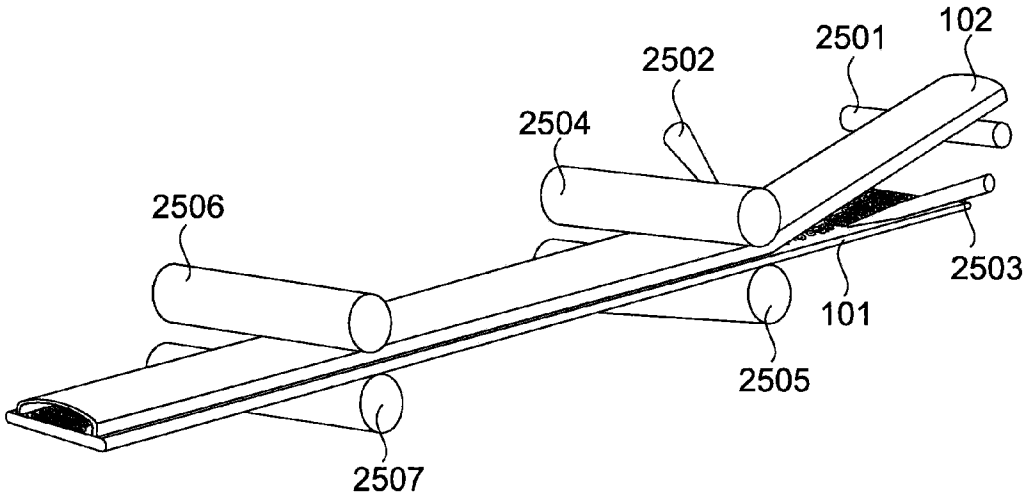
FIG. 25 illustrates schematically in perspective view, components of a manufacturing machine and process for bonding inner and outer strips together.

Referring to FIG. 25 herein, there is illustrated in perspective view main components of a machine for carrying out process 2402 of bonding the inner and outer strips of the first embodiment together to provide a combination contact strip.

The outer strip 102 and the inner strip 101 are each fed by a set of rollers to be arranged parallel to each other with the outer strip above the inner strip. A pair of glue injectors 2502, positioned either side of the inner strip inject glue onto the continuously travelling upper surfaces at the edges of the inner strip, so that two elongate beads of glue are formed on the inner strip.

The outer strip and inner strip are pressed together by a compression roller 2504, which can either press against another spring loaded roller 2505, or against a flat surface. The two rollers press the outer and inner strips together, locating the elongate ridges on the sides of the inner strip with the corresponding channels at the edges of the outer strip, and squeezing the glue between the contact points of the nitrol pillars and the upper surfaces of the inner strip.

The combined contact strip (outer and inner strip) is pulled through the compression roller 2504, 2505 by a set of drive rollers 2506, 2507 which are motor driven, so that the production process is continuous.

Individual lengths of contact strip are cut by a cutting machine (not shown in FIG. 25) which can be automated and computer controlled to cut the contact strip to pre-determined lengths, which can be varied for different customer orders.

The inner strip 101 is thermally co-extruded with the outer strip 102 to create a shaped body as shown in FIG. 2 herein. The combination of the metal mesh sock with PVC creates a material with inherited properties of the two materials. Thermally co-extruding these two materials together creates an homogenous material with the desired shape which enforces the shape memory and reduces the expansion properties of the final product.

For the outer strip 1092, the depth of the tubular mesh sock is controlled during the extrusion process so that a single face of the tubular sock is exposed to a depth of 25 μm to create an electrical contact, whilst the alternative face is totally absorbed into the PVC body. The resultant composite material has an homogenous structure that is shaped as a low arch with pads. The alignment ridges or protrusions 405, 407 are used as part of the manufactured assembly process to maintain the spacing between the cover and the backing strip.

The preferred polymer for the backing strip is PVC nitrite blend with a Young's Modulus of 8.5 MPa. Other suitable polymers can be used, in particular, rubber, silicone rubber, or nitrile rubber, depending on the application. Where PVC/rubber mix is used, the strip may remain flexible down to a temperature of around −20° C., and be operated up to a temperature of around hundreds of ° C., depending on the actual mix of rubber. Currently the best mode transparent outer strip blend has a range of −5° C. to 40° C. Another embodiment has nitrile mix throughout and has a range of −20° C. to 60° C. PVC has a limited low temperature range but is transparent. By mixing in rubber content this reduces transparency but increases the temperature range of effective operation. Silicon can provide enhanced temperature range and still provide good transparency. For lower temperature applications, down to −50° C., the upper and lower strips may be formed of silicone rubber, which retains its flexibility down to around −50° C.

The criteria for selection of the most suitable polymer include transparency, cost, the ability to produce a complex shaped extrusion, adhesion properties of the polymer to adhere the cover to the backing strip, and the mechanical properties of the material.

In the best mode, the backing strip is designed to be transparent and flexible with a degree of compressive properties. The addition of the tubular mesh sock as a thermally co-extruded part creates a composite material with an homogenous structure, which is extremely flexible and has good shape memory properties.

The cover strip 102 is thermally co-extruded with three elements: the tubular mesh sleeve; the roof portion, and the upright side or pillar portions to create the complete switch cover. The roof portion and side portions comprise two different polymers, PVC and nitrite, having different mechanical properties, in particular different Young's Modulus and elongation. Both of these two materials are co-extruded to make a single component.

For the inner strip 2101, the depth of the tubular mesh sleeve is also controlled during the extrusion process so that a single face of a tubular sleeve is exposed to create an electrical contact to a depth of 25 μm, whilst the alternative face is absorbed into the PVC arch. The resultant composite material has an homogenous structure which is shaped to give the look and feel of a flexible plastics strip. The central portion of the roof is manufactured from PVC. The overall shape of the component has a strong memory of its extruded shape.

The preferred polymer to be used for the inner strip 101 is PVC nitrite blend with a Young's Modulus in the range 7.5 MPa to 9.5 MPa and preferably of 8.5 MPa.

The inner strip 101 and the first electrically conductive mesh sleeve are formed together in a first extrusion, and the outer cover strip 102 and the second mesh sleeve are formed together in a second extrusion. The cover strip and inner strip are connected together along their first and second sides, and the sub-assembly as shown in FIG. 2 herein, may be deformed, and slid in under the upright side walls of the mounting strip as shown in FIG. 10 herein. The outer surfaces of the pillars of the cover strip are closely shaped to engage the inner surfaces of the side walls of the mounting strip 103, as the sub-assembly resumes it memorized shape within the mounting strip.

In embodiments where the upper bridge portion of the contract strip is a rigid material, movement of the outer strip towards the inner strip is accommodated primarily by the flexible nitrol pillars, which act under compression and/or rotation within the side walls of the mounting plate to effectively act as a hinge allowing a translational movement of the bridge of the outer strip, towards the inner conductive mesh contact.

The arched shape of the side walls of the mounting plate 103 tend to enforce the shape of the nitrol pillars and the inner and outer strips within the edges of the mounting plate. The inner strip has no hinge in it.

In free space, the nitrol pillars can act as a hinge, but when constrained by the sides 103, 104 of the mounting strip, the nitrol pillars act in compression, since they are constrained by the rigid mounting plate.

Other Embodiments

In a third embodiment, the contact strip is substantially as herein before described with reference to the first embodiment, with the exception that the outer (lower) strip 203 may be formed of a relatively more rigid material, so that under compression, the roof portion of the strip does not deform, or deforms only minimally, whereas the nitrile pillars 501, 502 extending along the sides of the roof portion deform, allowing movement of the outer or upper strip relative to the inner or lower strip, such that the first and second electrical conductors can make contact under compression of the upper (cover) strip. The bridge or roof portion of the upper strip may be relatively rigid, with the flexibility being provided by the nitrol lateral side pillar members. Many glue types such as cyanoacrylates, UV sensitive products, or hot melt glues may be used.

A fourth embodiment is substantially similar to the first embodiment, but with the following differences. In the fourth embodiment, the upper and lower strips may be formed in a same extrusion process as a single component, having the upper and lower electrical conductors extruded within the same extrusion process so as to become partially embedded either side of a tubular cavity along the center of the extruded component. Hence, the base portion, roof or bridge portion and the elongate lateral pillars between the roof portion and the base portion are all formed in the same extrusion process as a single compound component. This method of manufacture is an alternative to separate extrusion of the inner and outer strips, followed by joining the two strips together.

General construction and operation of the fourth embodiment is otherwise as described herein with respect to the first embodiment, and fitting of the extruded PVC or silicone strip into the cradling mounting strip is as described hereinbefore.

In a fifth embodiment, being a variation on the fourth embodiment, having a more rigid roof portion, the tubular strip components may be formed as a single extruded composite component comprising an inner elongate base, a first tubular web formed into an upper surface of the base strip; and an outer elongate web having a second electrical conductor in the form of a tubular web of mesh compressed into a lower surface of the outer strip; and first and second elongate nitrol lateral pillars, which may be formed of a more flexible material than the inner and outer strips, connecting the inner and outer strips along their respective first and second sides, so that the inner and outer strips and the nitrol pillars form an overall tubular shape as shown in FIG. 2, but as a single hollow tubular extrusion, avoiding the need to glue or otherwise connect two separate inner and outer strips together.

As with the first embodiment, the outer strip has a roof portion, which is moveable towards the inner strip to make contact of the first and second electrical conductors when the outer strip is pressed. The compression may be accommodated by the lateral pillars which may be of a more compressible and less rigid material than the outer and inner strips.

General construction and operation of the fifth embodiment is otherwise as described herein with respect to the first embodiment, and fitting or the extruded PVC or silicone strip into the cradling mounting strip is substantially as described hereinbefore.

In yet a further variation, the extruded aluminum base plate could be replaced by a plastics extrusion.

In each of the above embodiments, the outer strip may be replaced by a rigid strip, with the deformability being accommodated by the lateral pillars. Where a light source is not required, the outer strip could be replaced by for example a wooden strip, having an insulating liner, into which the mesh conductor is embedded. Therefore the outer strip could be made of a wide range of materials, including a range of plastics, any form of nitrol, or even wood.

Advantages

Compared to prior art contact strips, specific embodiments herein may give rise to fewer false alarms, since the electrical conductor is partially embedded within the surfaces surrounding the cavity, whereas prior art devices have separate copper strips which may become detached from the cavity roof and/or cavity floor.

Present embodiments having silicone components may have an improved range of temperature operation down to −50° C.

By using an elongate wire mesh electrically conductive strip, this may give improved cut resistance compared to a flat copper strip conductor. In situations where the strip may be liable to knife damage, a wire mesh conductor is more difficult to fully sever than a solid conventional copper conductor. A conductive mesh has more electrical paths than a single copper conductor, and is therefore failure of a single conductor has limited effect on the electrical functionality.

Further, by using a knitted mesh, the strip is more damage resistant than the equivalent woven mesh, due to the higher degree of connectivity between individual strands of the knitted mesh compared to a woven mesh.

Due to the lower conductivity per unit length, of a conductive mesh compared to a solid copper conductor, improved distance measurement resolution may be achieved using the wire mesh compared to a conventional elongate copper strip conductor.

By extruding the electrical conductor together with the material of the upper and lower strips, enhanced memory shape of the strip can be achieved, compared to a product which has a separate electrical conductor bonded to the upper and lower strips. A wider range of strike angle relative to a centre point of the strip can be achieved compared to prior art strips.

In use, the present embodiments are not susceptible to rippling of the user-pressable outer strip, nor to differential expansion or contraction rates of the outer conductor bearing strip relative to the inner conductor bearing strip, since the mesh expands or contracts at the same rate laterally or longitudinally at the same rate as the carrier material into which it is partially embedded.

Embodiments may have an easier manufacturing process than prior art contact strips which require bonding of a flat copper strip to a PVC carrier via a polyester intermediary strip, with the use of glue. The embodiments disclosed herein form the mesh strip with a carrier strip in a single extrusion process.

The invention claimed is:

1. An extended electrical contact strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming a cavity there between, such that said first and second electrical conductors lie opposite and spaced apart from each other and such that said first and second electrical conductors can make contact with each other when said first and second elongate strips are urged towards each other;

wherein at least one of said first and second electrical conductors comprises a web of electrically conductive mesh; and said at least one of said first and second electrical conductors is extruded with a material of a corresponding respective said first or second elongate strip, comprising a protruding ridge, and an elongate recessed channel each extending along a same side of said contact strip, for engaging said first elongate strip to said second elongate strip.

2. The contact strip as claimed in claim 1, wherein:

said first conductor comprises a first electrically conductive mesh; and said second conductor comprises a second electrically conductive mesh.

3. The contact strip as claimed in claim 1, wherein said second elongate strip comprises a first lateral pillar, and a second lateral pillar, and extending between said first and second lateral pillars a central portion, wherein said central portion spans across said cavity.

4. The contact strip as claimed in claim 1, wherein said second elongate strip comprises a first elongate lateral pillar and a second elongate lateral pillar at least one of said lateral pillars comprising a material selected from the set:

Poly Vinyl Chloride (PVC);

Nitrol;

Nitrile;

Nitrite;

Silicone;

Vulcanized silicone;

Rubber;

Vulcanized rubber;

a mixture of the aforesaid materials;

at least one of said first and second elongate strips comprising a material selected from the set:

Poly Vinyl Chloride (PVC);

Nitrol;

Nitrile;

Nitrite;

Silicone;

Vulcanized silicone;

Rubber;

Vulcanized rubber;

a mixture of the aforesaid materials.

5. The contact strip as claimed in claim 1, wherein said second elongate strip comprises a first lateral pillar, a second lateral pillar, and extending between said first and second lateral pillars, said central portion, wherein said central portion has a different Young's Modulus to said first and second lateral pillars, and said first and second lateral pillars and said central portion are formed together in a single extrusion process.

6. The contact strip as claimed in claim 1, wherein said second strip comprises a first lateral pillar, a second lateral pillar, and extended between said first and second lateral pillars, said central portion, wherein pressure applied to said central portion is transmitted across a width of said central portion to said first and second lateral pillars.

7. The contact strip as claimed in claim 1, wherein said second strip comprises a first lateral portion, a second lateral portion, and extended between said first and second lateral portions, said central portion, wherein pressure applied to said central portion is transmitted across a width of said central portion to said first and second lateral portions, wherein said first and second lateral portions deform under pressure applied to said central portion, so as to allow said second electrically conductive strip to contact said first electrically conductive strip.

8. The contact strip as claimed in claim 1, wherein said at least one electrical conductor comprises a tubular mesh sleeve.

9. The contact strip as claimed in claim 1, wherein said at least one electrical conductor comprises a tubular mesh sleeve, and said mesh comprises a plurality of wires; and said mesh has a structure selected from the following set:

braided;

woven;

knitted.

10. The contact strip as claimed in claim 1, wherein said first elongate strip comprises a first lateral side portion and a second lateral side portion; and extending between said first and second lateral side portions, an arched portion;

wherein said first electrical conductor is located on an upper face of said arched portion.

11. The contact strip as claimed in claim 1, wherein said first elongate strip comprises a first lateral side portion and second lateral side portion; and extended between said first and second lateral side portions, an arched portion; and said first electrical conductor comprises a mesh of conductive material; and said mesh of conductive material is at least partially embedded in an upper surface of said arched portion.

12. The contact strip as claimed in claim 1, comprising a linearly extending engagement means extending along at least one side of said contact strip, for connecting said first elongate strip to said second elongate strip.

13. An extended electrical contact strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming a cavity there between, such that said first and second electrical conductors lie opposite and spaced apart from each other and such that said first and second electrical conductors can make contact with each other when said first and second elongate strips are urged towards each other;

wherein at least one of said first and second electrical conductors comprises a web of electrically conductive mesh; and said at least one of said first and second electrical conductors is extruded with a material of a corresponding respective said first or second elongate strip, further comprising an elongate mounting strip, said elongate mounting strip formed of a rigid material, and configured for holding said first and second elongate strips.

14. An extended electrical contact strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming a cavity there between, such that said first and second electrical conductors lie opposite and spaced apart from each other and such that said first and second electrical conductors can make contact with each other when said first and second elongate strips are urged towards each other;

wherein at least one of said first and second electrical conductors comprises a web of electrically conductive mesh; and said at least one of said first and second electrical conductors is extruded with a material of a corresponding respective said first or second elongate strip, further comprising an elongate mounting strip, said elongate mounting strip formed of a rigid material, and configured for holding said first and second elongate strips, said elongate mounting strip comprising:

an elongate base portion;

at a first side of said elongate base portion, a first upright wall portion; and at a second, opposite side of said elongate base portion, a second upright elongate wall, said base portion, first and second wall portions defining a channel shaped to hold said first and second elongate strips.

15. An extended electrical contact strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming a cavity there between, such that said first and second electrical conductors lie opposite and spaced apart from each other and such that said first and second electrical conductors can make contact with each other when said first and second elongate strips are urged towards each other;

wherein at least one of said first and second electrical conductors comprises a web of electrically conductive mesh; and said at least one of said first and second electrical conductors is extruded with a material of a corresponding respective said first or second elongate strip, wherein said first conductor comprises a first electrically conductive mesh; and said second conductor comprises a second electrically conductive mesh, further comprising an elongate mounting strip, said elongate mounting strip formed of a rigid material and configured for holding said first and second elongate strips, wherein an upper surface of said elongate mounting strip has a shape which closely matches and supports an under-surface of said second elongate strip.

16. A method of manufacturing an extended contact strip, said strip comprising:

a first elongate strip having first and second longitudinal sides, an upper surface and a lower surface;

a first electrical conductor located on said upper surface of said first elongate strip;

a second elongate strip having first and second longitudinal sides, and a central portion extending between said first and second sides, said central portion having an upper surface and a lower surface;

a second electrical conductor located on said lower surface of said second strip;

said first and second elongate strips forming a cavity there between, such that said first and second electrical conductors lie opposite and spaced apart from each other when said second strip remains uncompressed, and such that said first and second electrical conductors can make contact with each other upon compression of said second strip;

said method comprising:

forming said first elongate strip and said first electrical conductor as a first extrusion said first extrusion having a first side and a second side;

forming said second elongate strip and said second electrical conductor as a second extrusion, said second extrusion having a first side and a second side; and joining said first and second extrusions together along their corresponding respective first sides and second sides, further comprising:

forming an elongate mounting strip having first and second extended side wall portions which are shaped so as, in use, to enclose correspondingly shaped portions of said first and second elongate strips; and compressing said first and second elongate strips in a direction transverse to a main length of said strips, so as to insert said first and second sides of said first and second strips, adjacent said corresponding respective first and second side walls of said mounting strip, such that said first and second strips are retained within said mounting strip between said side walls.

17. The method as claimed in claim 16, wherein said method further comprises applying glue to said first and second strips to join said strips together along their respective first and second sides.

18. An extended electrical contact strip comprising:

an elongate strip having first and second longitudinal sides, an upper surface and a lower surface;

an electrical conductor located on said upper surface of said first elongate strip;

a second elongate strip having first and second longitude sides, and a central section extending between the first and second sides, said central section having an upper surface and a lower surface;

a second electrical conductor located on said lower surface of said second strip;

said first and second strips forming a cavity there between, such that said first and second electrical conductors lie opposite and spaced apart from each other when said first and second strips remains spaced apart, and such that said first and second electrical conductors can make contact with each other when said first and second strips are urged towards each other;

wherein as least one of said first or second electrical conductors are extruded into said corresponding respective first or second elongate strips; and said first and second elongate strips are co-extruded with each other, further comprising an elongate mounting strip, said elongate mounting strip formed of a rigid material and configured for holding said first and second elongate strips, wherein an upper surface of said elongate mounting strip has a shape which closely matches and supports an under-surface of said first elongate strip.

19. The contact strip as claimed in claim 18, wherein at least one of said first and second electrical conductors comprises an electrically conductive knitted mesh.

20. The contact strip as claimed in claim 18, wherein said first and second elongate strips, and said first and second electrical conductors are formed together as a single compound component in a single extrusion process.

21. The contact strip as claimed in claim 18, wherein said second elongate strip comprises a first elongate lateral pillar and a second elongate lateral pillar;

said lateral pillars each comprise a Nitrol material; and said first and second elongate strips each comprise a material selected from the set:

Poly Vinyl Chloride (PVC);

Nitrol; and

Silicone.

22. The extended contact strip as claimed in claim 18, wherein said second elongate strip comprises a first lateral pillar, a second lateral pillar, and extending between said first and second lateral pillars, a central portion, wherein said central portion has a different Young's Modulus to said first and second lateral pillars.

23. The contact strip as claimed in claim 18, wherein said first elongate strip comprises a polyvinyl chloride nitrite blend having a Young's Modulus in the range 7.5 MPa to 9.5 Mpa.

24. The contact strip as claimed in claim 18, wherein said at least one electrical conductor comprises a tubular mesh sleeve, and said mesh comprises a plurality of wires; and said mesh has a structure selected from the following set:

braided;

woven;

knitted.

25. The contact strip as claimed in claim 18, further comprising a channel extending along the length of said mounting strip; and at least one light source positioned in said channel.

* * * * *